US005678818A

United States Patent [19]

Hayashi et al.

[11] Patent Number: 5,678,818

[45] Date of Patent: Oct. 21, 1997

[54] SHEET POST-TREATMENT APPARATUS

[75] Inventors: Kenichi Hayashi, Tokyo; Yoshifumi Takehara, Yokohama, both of Japan

[73] Assignee: Canon Kabushiki Kaisha, Tokyo, Japan

[21] Appl. No.: 651,007

[22] Filed: May 21, 1996

Related U.S. Application Data

[63] Continuation of Ser. No. 222,875, Apr. 5, 1994, abandoned.

[30] Foreign Application Priority Data

Apr. 7, 1993 [JP] Japan ..... 5-080656

[51] Int. Cl.[6] ..... B65H 39/10

[52] U.S. Cl. ..... 271/292; 271/294; 271/287; 271/220; 271/3.03; 270/53; 414/790.2

[58] Field of Search ..... 414/331, 790.2 CR; 271/3.03 CR, 220 CF, 292, 294 CR, 287 CR; 270/53 CR

[56] References Cited

U.S. PATENT DOCUMENTS

| | | | |
|---|---|---|---|
| 4,037,832 | 7/1977 | Looney | 271/294 |
| 4,068,837 | 1/1978 | Lamos | 271/220 |
| 4,361,393 | 11/1982 | Noto | 271/294 |
| 4,385,827 | 5/1983 | Naramore | 271/292 |
| 4,900,009 | 2/1990 | Kitahara et al. | 271/292 |
| 4,928,941 | 5/1990 | Uto et al. | 270/53 |
| 4,930,761 | 6/1990 | Naito et al. | 270/53 |
| 5,217,215 | 6/1993 | Ohato et al. | 271/294 |

FOREIGN PATENT DOCUMENTS

| | | | |
|---|---|---|---|
| 63-267667 | 4/1988 | Japan | 271/220 |
| 4-146674 | 6/1989 | Japan . | |
| 4-288292 | 10/1992 | Japan . | |

*Primary Examiner*—Karen B. Merritt
*Assistant Examiner*—Douglas Hess
*Attorney, Agent, or Firm*—Fitzpatrick, Cella, Harper & Scinto

[57] ABSTRACT

The present invention provides a sheet post-treatment apparatus comprising a sheet bundle convey unit including at least one sheet receiving tray unit capable of accommodating a sheet, a convey unit for conveying the sheet on the sheet receiving tray unit, and a sheet stacking tray for receiving the sheet and for stacking the sheets thereon. Apparatus includes a hold member capable of shifting between a first position where the hold member is overlapped with a stacking surface of the sheet stacking tray above the stacking surface, and a second position where the hold member is retracted from the stacking surface. When the sheet is conveyed to the stacking surface, the hold member supports a rear end portion of the sheet at the first position, and the hold member is shifted to the second position at a predetermined timing to drop a rear end portion of the sheet, thereby stacking the sheets.

20 Claims, 26 Drawing Sheets

SHEET POST-TREATMENT APPARATUS

This application is a continuation of application Ser. No. 08/222,875 filed Apr. 5, 1994, now abandoned.

BACKGROUND OF THE INVENTION

1. Field of the Invention

The present invention relates to a sheet post-treatment apparatus having a sheet bundle convey means, and more particularly, it relates to a sheet post-treatment apparatus having a sort device for successively sorting and accommodating output copies discharged from an image forming apparatus such as a copying machine, a printing device and the like in a sheet receiving tray or trays (referred to as "bin tray" hereinafter) and a stack device for stacking sheets to obtain a sheet bundle, and an image forming apparatus.

2. Related Background Art

In the past, many sheet post-treatment apparatuses having a plurality of bin trays and adapted to sort and accommodate sheets have been proposed, as disclosed in the Japanese Patent Laid-Open No. 4-288292 (laid-open on Oct. 13, 1992). Such a sheet post-treatment apparatus comprises a sort device having at least one bin tray and adapted to sort sheets, and a stack device attached to the sort device and having a stack tray for accommodating the sheets sent from the bin tray successively. The bin tray of the apparatus has a downwardly inclined sheet stopper so that one lateral edge of the sheet discharged onto the bin tray is regulated by the sheet stopper. Further, a stapler is arranged in a confronting relation to the sheet stopper so that the needle stapling operation regarding the sheets contained in the bin tray can be effected by the stapler.

However, in the above-mentioned conventional apparatus, when the sheets received on the bin tray are stapled by the stapler to form a sheet bundle and the sheet bundle is transferred onto the stack tray, the following problems arose.

As shown in FIG. 27, since a staple $T_1$ of the sheet bundle $S_1$ accommodated in the stack tray 401' is abutted against a tip end portion $\alpha$ of a next sheet bundle $S_2$ sent from the bin tray B' by means of convey rollers, the position of the sheet bundle $S_1$ on the stack tray is shifted to a direction shown by the arrow. Further, when the tip end $\alpha$ of the next sheet bundle $S_2$ is abutted against the staple, it is feared that the tip end is buckled.

When the tip end $\alpha$ of the next bundle $S_2$ is not abutted against the staple $T_1$, as shown in FIG. 28, if a staple $T_2$ of the next sheet bundle $S_2$ is abutted against a rear end portion $\beta$ of the sheet bundle $S_1$, the poor stacking as mentioned above will occur.

Further, when a fixing device of an image forming apparatus includes a heat roller, since moisture in the sheet is greatly reduced after the fixing operation, curl is generated in the sheet depending upon the inherent feature of the image forming apparatus. As shown in FIG. 29, when the next sheet bundle $S_2$ is discharged onto the stack tray on which the curled sheet bundle $S_1$ is already rested, since the tip end portion $\alpha$ of the next sheet bundle $S_2$ is abutted against the floating rear end portion $\beta$ of the sheet bundle $S_1$, the poor stacking as mentioned above will occur. Such poor stacking will occur regarding non-stapled sheet bundle which is not stapled in the sort device.

SUMMARY OF THE INVENTION

The present invention aims to eliminate the above-mentioned conventional drawbacks, and has an object to provide a sheet post-treatment apparatus wherein a stapled sheet bundle or a non-stapled sheet bundle can be sent to and rested on a stack tray while maintaining the registration of the sheet bundle.

According to the present invention, in order to achieve the above object, there is provided a sheet post-treatment apparatus comprising at least one bin tray for sorting and accommodating sheets, a sheet discharge means for discharging the sheets onto the bin tray, a convey means for conveying a sheet bundle on the bin tray, and a stack tray for receiving the conveyed sheet bundle and for resting the sheet bundle thereon, and further comprising a holding means for holding a rear end portion of a first sheet bundle discharged from the convey means, thereby preventing poor registration by separating a next sheet bundle from the first sheet bundle rested on the stack tray.

More particularly, the holding means is arranged above an end portion (near the convey means) of the sheet bundle rested on the stack tray so that the holding means can be moved toward and away from the sheet bundle. And, when the sheet bundle is conveyed, the holding means is extended to cover the end portion, thereby preventing the abutment between the end portion of the sheet bundle rested on the stack tray and a tip end portion of the next sheet bundle. Further, the holding means also acts as a guide for the conveyed sheet bundle, thereby making the apparatus compact.

Since the sheet post-treatment apparatus according to the present invention has the above-mentioned construction so that the sheet already rested on the stack tray is separated from the next sheet sent to the stack tray by means of the holding means, the interference between the sheets can be avoided, thereby improving the stacking ability.

Further, since the holding means is constituted by a portion of an intermediate tray, a length of the intermediate tray can be reduced, thereby making the entire apparatus compact.

DETAILED DESCRIPTION OF THE PREFERRED EMBODIMENTS

Figure 1:
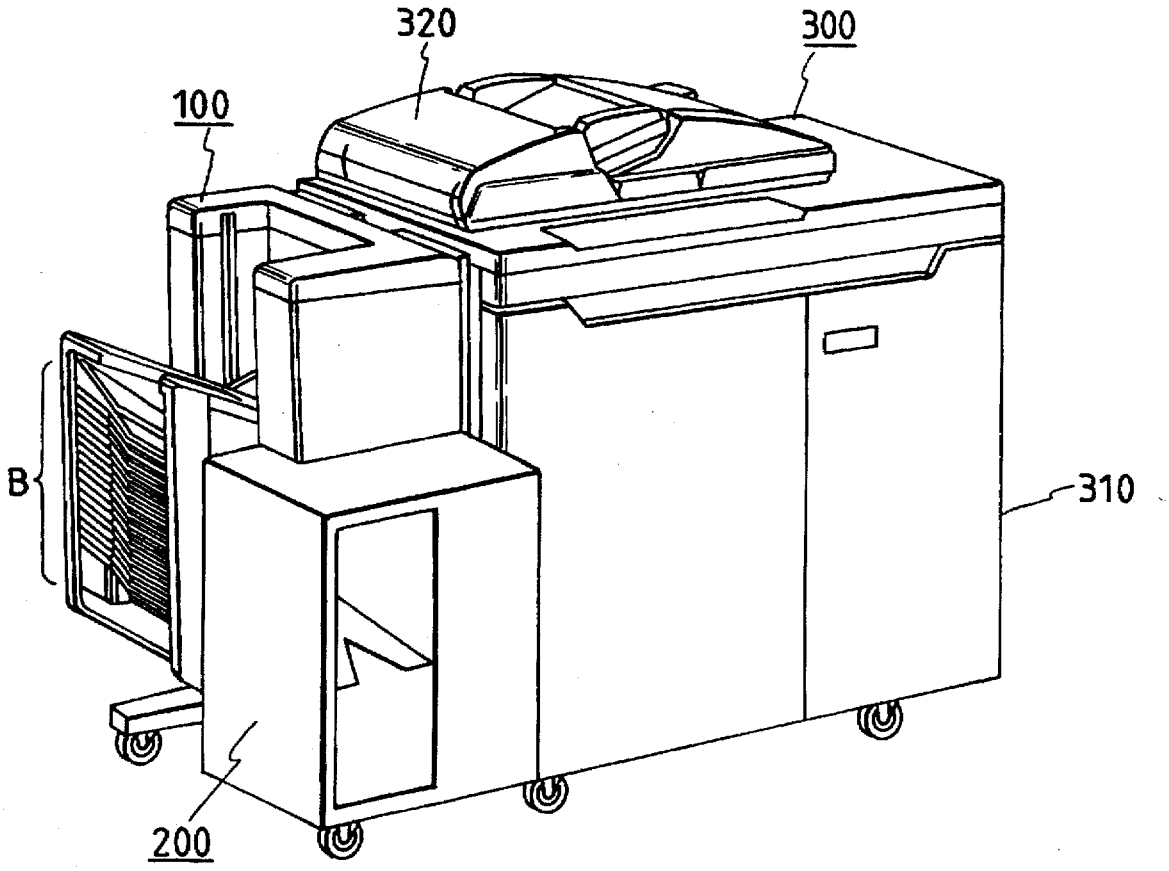
FIG. 1 is a perspective view of an image forming apparatus having a sheet post-treatment apparatus according to the present invention.

The present invention will now be explained in connection with embodiments thereof with reference to the accompanying drawings. FIG. 1 is a perspective view of an image forming apparatus having a sheet post-treatment apparatus according to the present invention. A sort device 100 having at least one bin tray B is arranged at a downstream side of a body 310 of the image forming apparatus, and a stack device 200 for stacking sheets in a body thereon is arranged at a front side of the sort device 100.

Figure 2:
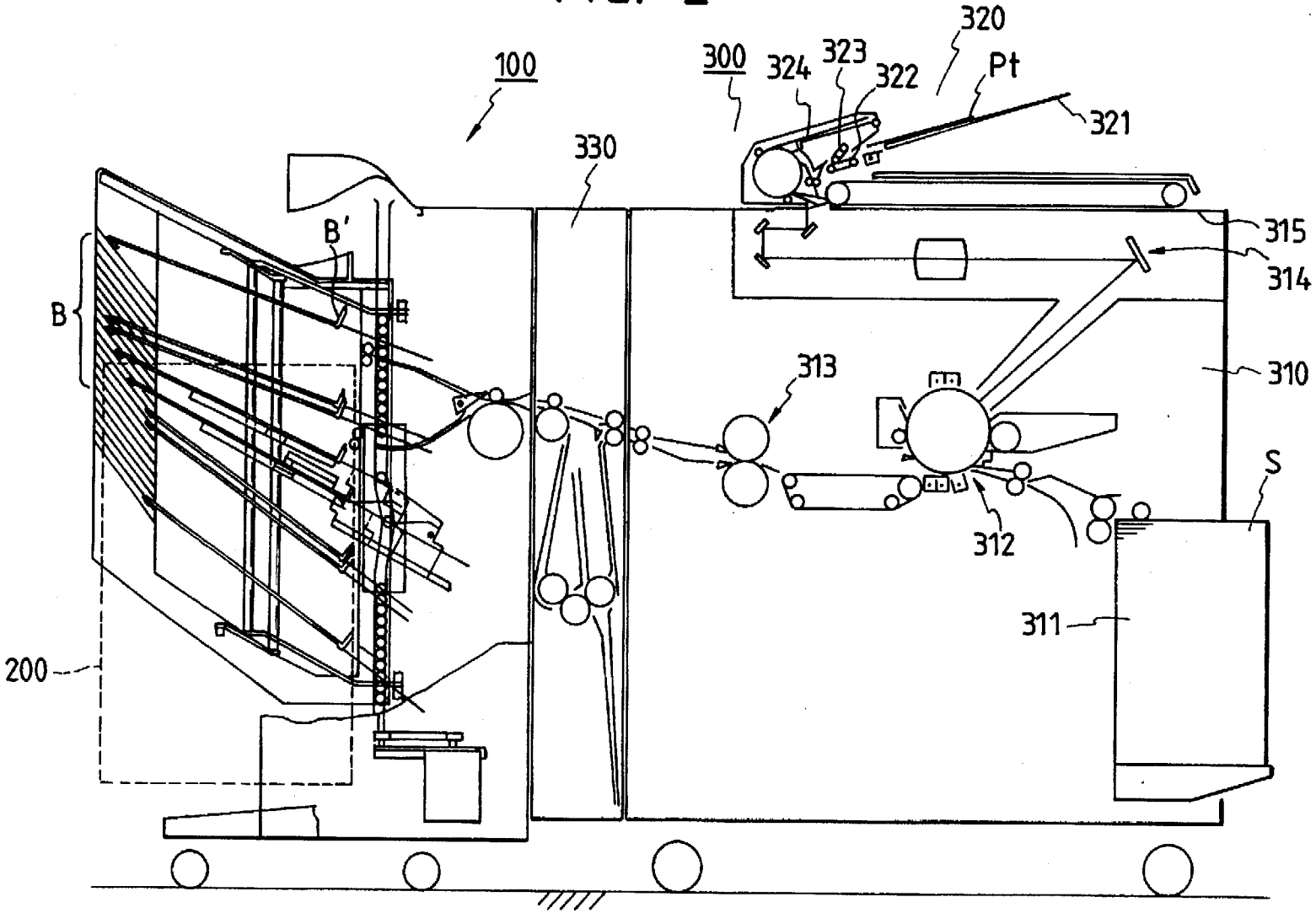
FIG. 2 is an elevational sectional view of a main portion of the image forming apparatus having the sheet post-treatment apparatus according to the present invention.

FIG. 2 is a sectional view showing a concrete construction of the image forming apparatus 300. As shown in FIG. 2, the image forming apparatus 300 comprises the body 310 (constituted by a sheet supply deck 311, a photosensitive body 312, a fixing device 313, an image reading device 314, a platen glass 315 and the like), an automatic original feed apparatus 320 arranged on the body 310, and a folding device 330, the sort device 100 and the stack device 200 which are arranged at a downstream side of the body 310.

Further, originals $P_1$ rested on an original stacking plate 321 of the automatic original feed apparatus 320 are separated one by one from the lowermost one by means of a separation means 322, and the separated original is supplied onto the platen glass 315 of the apparatus body 310 through a path 323. After an image on the original is read by the optical system of the apparatus body 310 by a predetermined number of times, the original is discharged onto the original stack rested on the original stacking plate 321 through a path 324. Incidentally, a partition lever is interposed between the non-treated originals and the treated originals to discriminate the treated originals from the non-treated originals.

Figure 3:
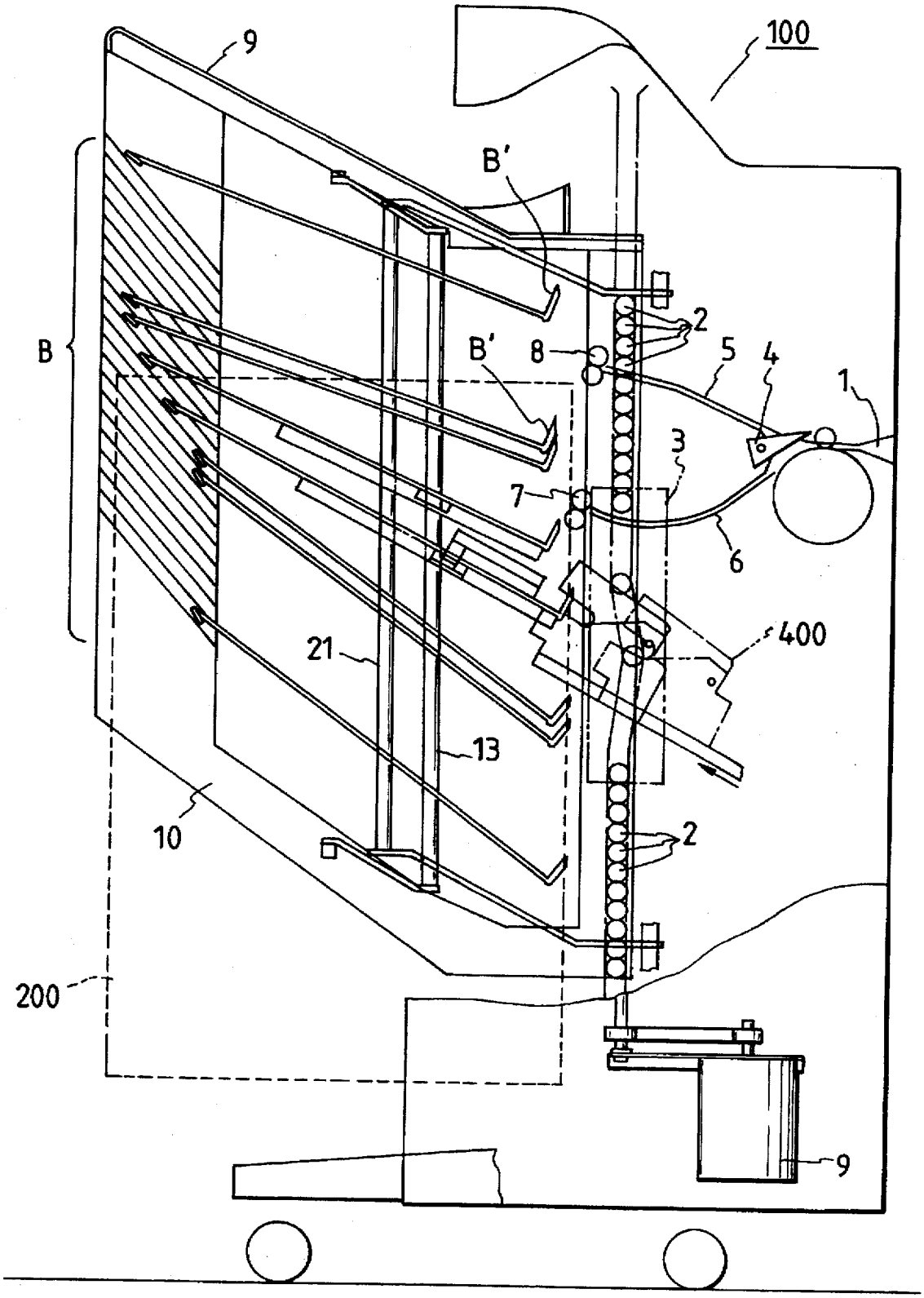
FIG. 3 is a sectional view of a main portion of the sheet post-treatment apparatus.

FIG. 3 is an enlarged sectional view of the sort device 100. The sort device 100 includes one or more bin trays B which are arranged side by side in a vertical direction. The bin trays B can be lifted and lowered one by one by one revolution of a lifting/lowering rotary members 3 each of which has a peripheral groove into which one of pins 2 attached to both ends of the bin tray is fitted.

A sheet on which an image was copied in the apparatus body 310 enters into a guide entrance 1, and then is introduced into a sort path or a non-sort path by a switching flapper 4. In the non-sort mode, the flapper 4 is positioned at a position shown by the broken line. In this case, the sheet enters into the non-sort path 5 and then is discharged onto a non-sort tray 9 by means of discharge rollers 8. On the other hand, in the sort mode, the flapper 4 is positioned at a position shown by the solid line. In this case, the sheet enters into the sort path 6 and then is discharged onto one of the bin trays B.

Incidentally, a staple unit 400 serves to staple a sheet bundle accommodated in each bin tray B. The stack device 200 (described later) for accommodating the sheet bundles collectively is arranged on this side of the sort device 100, as shown by the broken line.

Next, a bin unit 10 adapted to stack the sheets on the bin trays B and having an align means (fully described later) for aligning the sheets accommodated in the bin tray will be explained.

Figure 4:
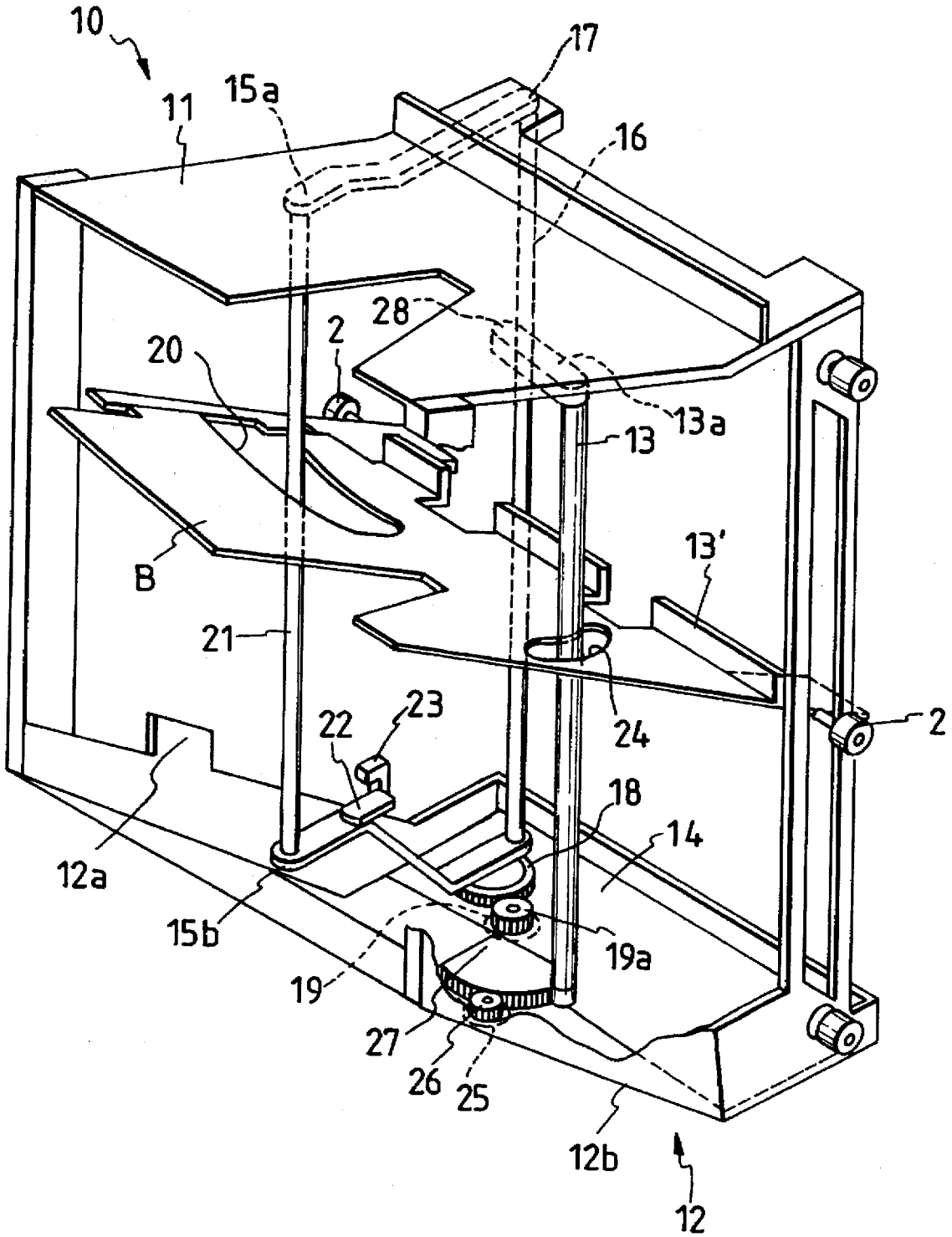
FIG. 4 is a perspective view of a bin unit.

As shown in FIG. 4, the bin unit 10 has an align standard member 13 which can abut against the sheets and which extends from a bin cover 11 to a bottom of a bin frame 12. A support plate 14 is secured to the base of the bin frame 12, and a central rotary shaft 16 having a lower end secured to a lower arm 15*b* is rotatably supported by a bearing (not shown) provided on the support plate 14 and a bearing 17 provided on the bin cover 11.

Further, a sector gear 18 is rotatably mounted on a rotary shaft secured to the support plate 14 and the lower arm 15*b* is secured to the sector gear 18. Further, a pulse motor 19 is arranged below the support plate 14, and a gear 19*a* a secured to an output shaft of the pulse motor 19 is meshed with the sector gear 18.

An align rod 21 extending through slots 20 formed in the respective bin trays B is connected between a free end of the lower arm 15*b* and a free end of an upper arm 15*a* a so that the align rod 21 can be rocked by the rotation of the sector gear 18. Further, a shield plate 22 is secured to the lower arm 15*b* so that the shield plate can be rotated together with the lower arm, thereby turning ON or OFF a home position sensor 23 arranged on that side of the bin frame 12.

Further, a standard rod 13 extending through slots 24 formed in the respective bin trays B is arranged in front of the align rod 21 and is attached to the support plate 14 secured to the base end of the bin frame 12. A pulse motor 25 arranged below the support plate 14 has an output shaft to which a gear 26 is secured, and the gear 26 is meshed with a sector gear 27. The standard rod 13 is attached to the sector gear 27 so that the standard rod 13 can be rocked around a fulcrum 28 by the rotation of the pulse motor 25. Incidentally, the fulcrum 28 is constituted by a recess formed in one end portion of the upper arm 15*a* a and a projection formed on the bin cover 11 at a predetermined position and fitted into the recess.

Figure 5:
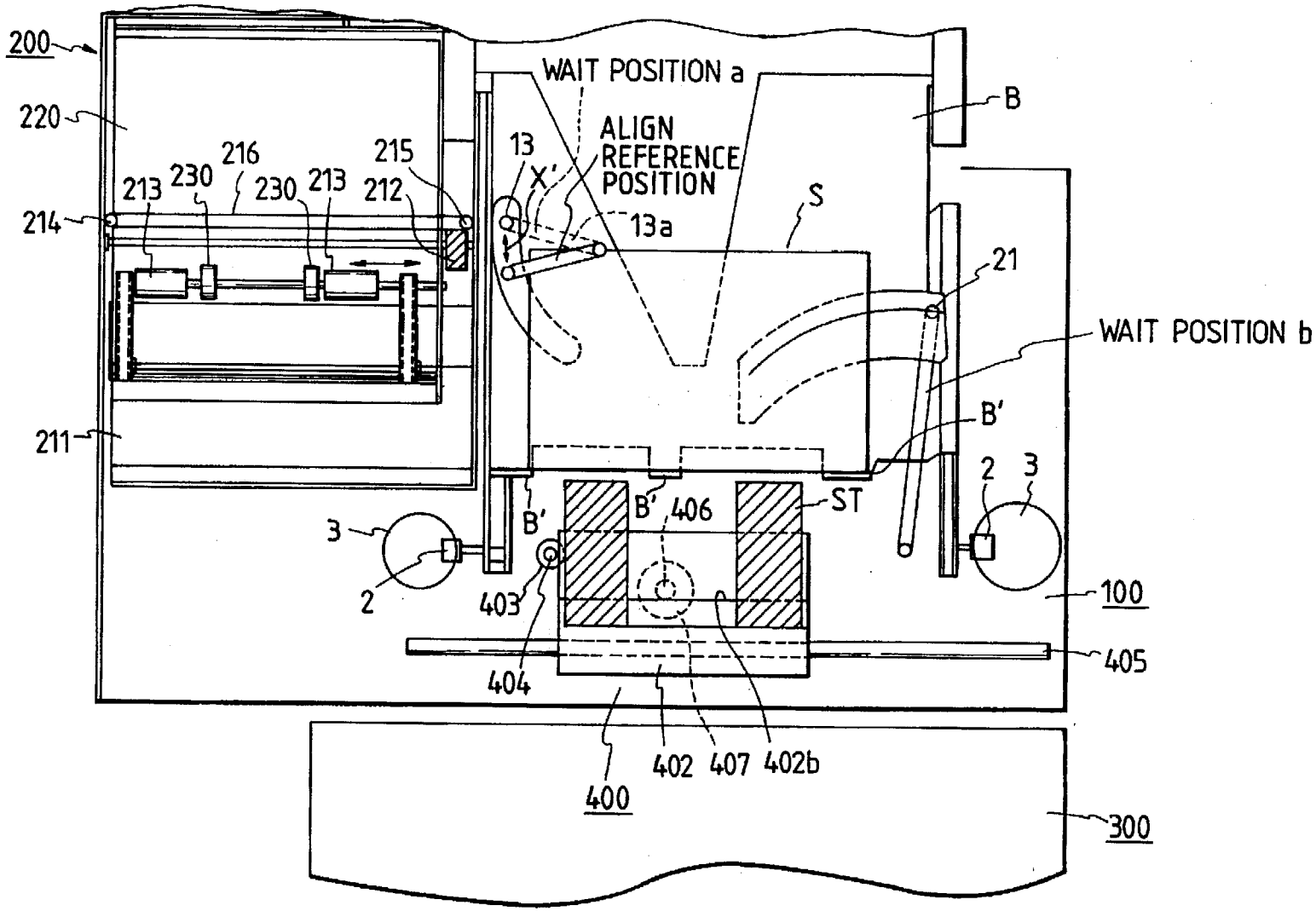
FIGS. 5 and 6 are top views of the sheet post-treatment apparatus.

As shown in FIG. 5 which is a top view of the sheet post-treatment apparatus, when a copying operation of the image forming apparatus body 310 is started, the standard rod 13 stopped at a wait position a (shown by the broken line) is shifted, by the rotation of the pulse motor 25, in a direction shown by the arrow X' to be brought to an align standard position (shown by the solid line). Thereafter, the sheet on which the image was formed in the body 310 of the image forming apparatus is discharged onto the bin tray B by the discharge rollers 7. Then, the sheet is moved on the downwardly inclined bin tray by its own weight toward a rear end stopper B' of the bin tray.

Figure 6:
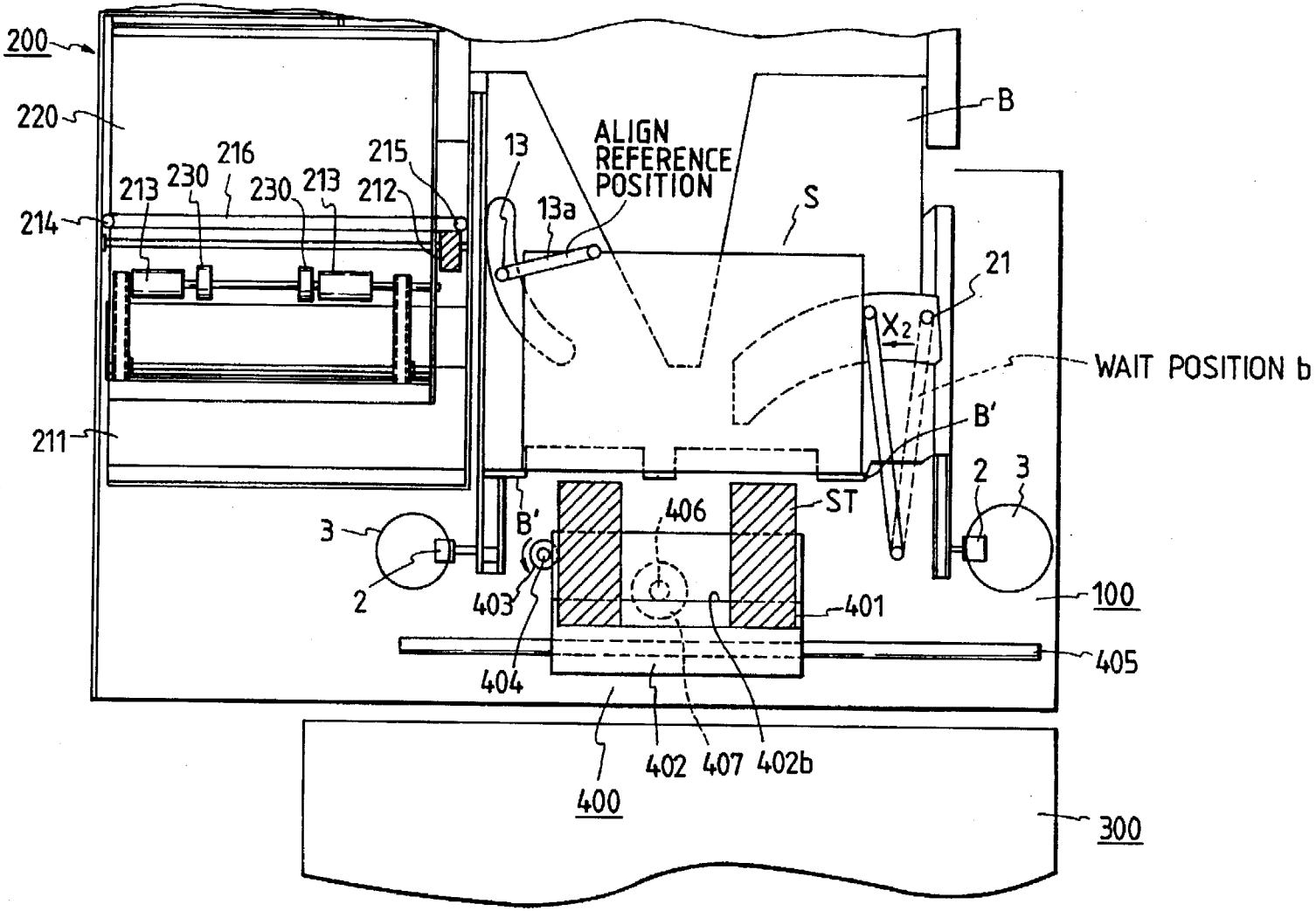

Then, as shown in FIG. 6, the align rod 21 is shifted from a wait position b (shown by the broken line) in a direction shown by the arrow $X_2$ by a predetermined amount by means of the pulse motor 19 rotated in response to a signal corresponding to a sheet size, with the result that the align rod is brought to a position (shown by the solid line), where the sheet is urged against the standard rod 13 stopped at the align standard position. The standard rod 13 continues to be stopped at the align standard position until all of the sheets from the image forming apparatus 300 are accommodated in the bin trays B; whereas, the align rod 12 returned to the wait position b for preparation for a next sheet after the algin rod was shifted by the predetermined amount. By repeating the above-mentioned operations, a sheet bundle comprising two or more sheets is accommodated in each bin tray B and the sheets in the sheet bundle are aligned with each other by abutting the lateral edges of the sheets against the standard rod 13 and by abutting the rear ends of the sheets against the rear end stopper B' of the bin tray B. Incidentally, since the align rod 12 extends through all of the bin trays B, the sheets accommodated in the other bin trays are also aligned with each other.

The staple unit 400 incorporated into the sort device 100 performs the stapling operation regarding the sheet bundle accommodated in the bin trays B supported by the lifting/lowering rotary member 3.

Figure 7:
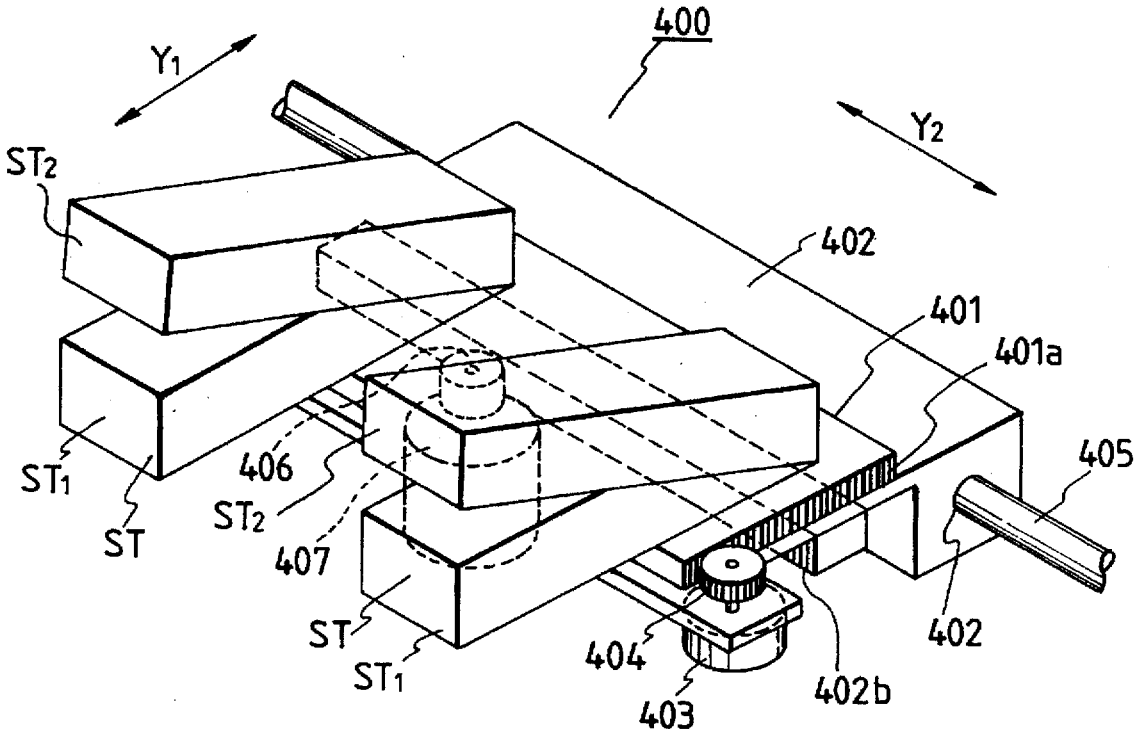
FIG. 7 is a perspective view of a stapler unit.

As shown in FIG. 7, the staple unit 400 has two electrically-driven staplers ST which are secured to a first tray 401. The first tray 401 is connected to a second lower tray 402, and a rack gear 401*a* a formed on a side surface of the first tray 401 is engaged by a pinion gear 404 of a motor 403 secured to the second tray 402 so that the first tray can be reciprocally shifted in directions shown by the arrow $Y_1$. Further, a bore 402*a* formed in the second tray 402 is fitted on a guide rail 405 attached to a body frame (not shown) of the sorter and a rack gear 402*b* formed on the second tray 402 is engaged by a pinion gear 406 of a motor 407 so that the second tray can smoothly be shifted reciprocally in directions shown by the arrow $Y_2$. Incidentally, the electrically-driven staplers ST may be of the type disclosed in the Japanese Patent Laid-Open Appln. No. 1-146674, for example, wherein the sheet bundle is interposed between an upper jaw and a lower jaw, and a staple is driven into the sheet bundle by a crinching operation of the upper and lower jaws.

Figure 8:
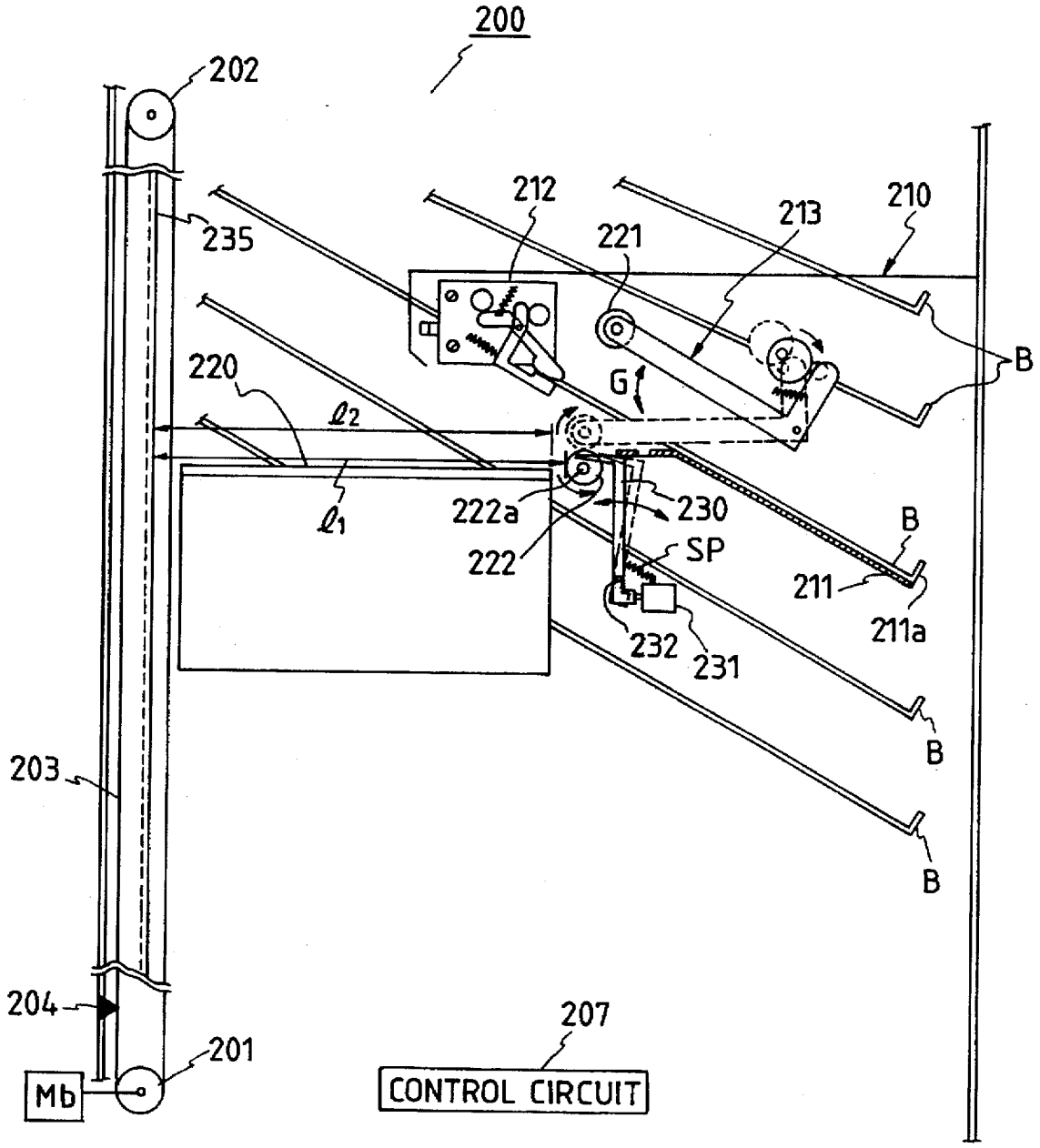
FIG. 8 is a sectional view of a main portion of a stack device.

Next, the construction of the stack device 200 will be explained. As shown in FIG. 8 which is a sectional view of a main portion of the stack device 200 and FIG. 9 which is a top view of the stack device, the stack device 200 comprises an intermediate unit 210 for conveying the sheet bundle, and a stack tray 220 on which the conveyed sheet bundle is rested.

The intermediate unit 210 is secured to a frame (not shown) of the stack device 200 at a position where the intermediate unit can be opposed to all of the bin trays lifted or lowered by the rotation of the lifting/lowering rotary member 3 of the sort device 100. On the other hand, the stack tray 220 is secured to a belt 203 extend between and wound around a drive pulley 201 and a drive pulley 202, which pulleys are provided on the frame of the stack device 200 which extends in a vertical direction. Thus, the stack tray can be shifted in an up-and-down direction by rotating the drive pulley 201 by means of a reversible motor Mb.

The intermediate unit 210 comprises a gripper unit 212 for conveying the sheet from the sort device 100 to the stack device 200, an intermediate tray 211 for temporarily storing the sheet bundle, a convey unit 213 for conveying the sheet bundle from the intermediate tray 211 to the stack tray 220, and a hold arm 230 positioned at a downstream side of the convey unit 213 and adapted to hold a rear end portion of the sheet discharged from the convey unit 213.

Figure 9:
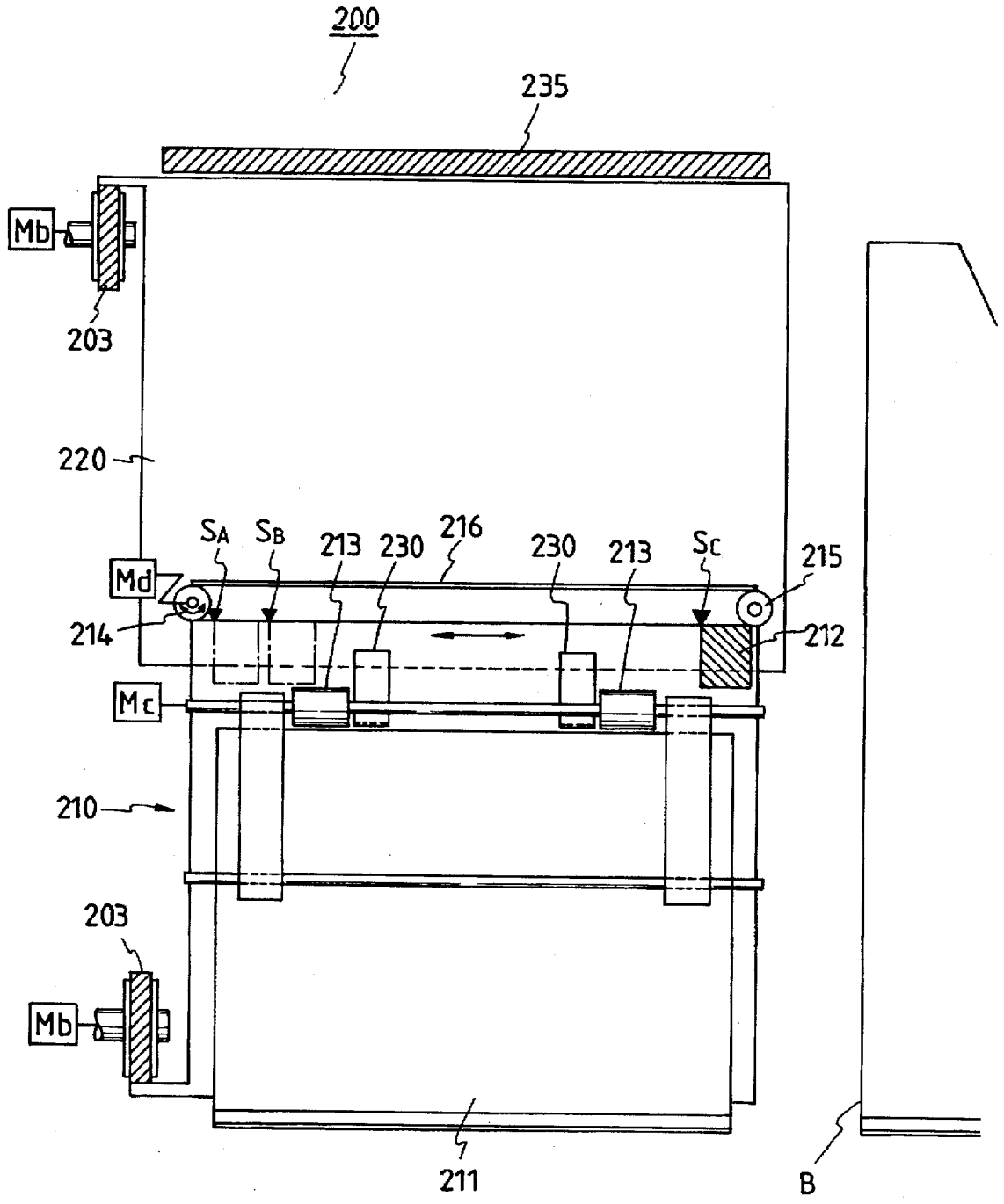
FIG. 9 is a top view of the stack device.
Figure 10:
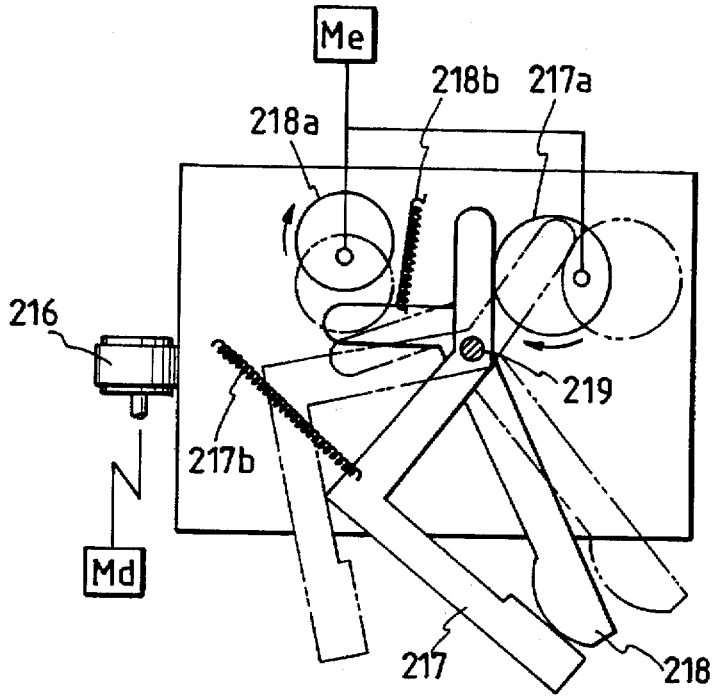
FIG. 10 is an explanatory view showing a gripper unit.

The intermediate tray 211 is secured to a frame (not shown) of the intermediate unit 210 while inclining in parallel with the bin trays B, and a sheet stopper 211*a* is uprightly formed on the rear end of the intermediate tray. As shown in FIG. 9, the gripper unit 212 is secured to a belt 216 extending between and wound around a front drive pulley 214 and a rear pulley 215, which pulleys are provided on both ends of the frame (not shown) of the intermediate unit 210 which extends in a front and rear direction. Thus, the intermediate tray can be reciprocally shifted in directions shown by the arrow by rotating the front pulley 214 by means of a reversible motor Md. The frame is provided with a sensor Sc for detecting a third position (shown by the solid line) of the gripper unit 212, a sensor $S_A$ for detecting a first position (shown by the dot and chain line), and a sensor $S_B$ for detecting a second position (shown by the two-dot and chain line). Further, as seen in FIG. 10, the gripper unit 212 has a lower gripper arm 217 and an upper gripper arm 218 which are supported on a shaft 219 and against which eccentric cams 217*a*, 218*a* are abutted, respectively. By rotating the eccentric cams 217*a*, 218*a* by means of a motor Me, the gripper arms 217, 218 can be rocked between solid line positions (pinching positions) and two dot and chain line positions (release positions). Further, spring members 217*b*, 218*b* connected to the gripper arms 217, 218, respectively, serve to always urge the gripper arms against the eccentric cams and provide a predetermined pinching force (nip force).

Figure 11:
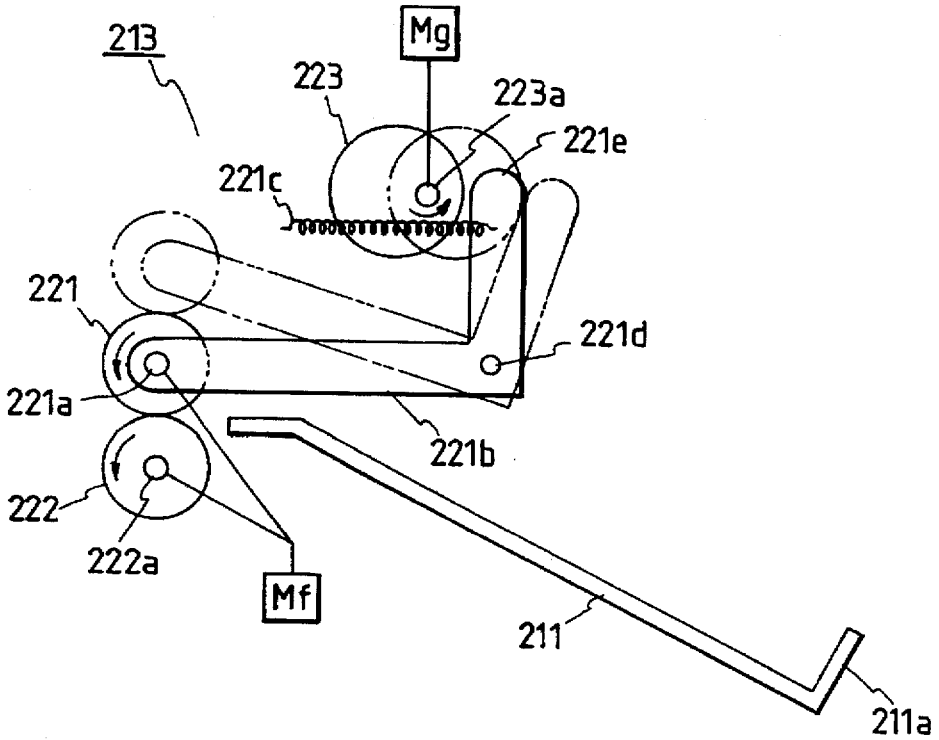
FIG. 11 is an explanatory view showing a convey unit.

Next, the convey unit 213 will be explained with reference to FIG. 11. Two lower convey rollers 222 are spaced apart from each other in an axial direction and are mounted on a lower roller shaft 222*a* supported by front and rear side plates (not shown) of the intermediate unit 210, and upper convey rollers 221 are mounted on an upper roller shaft 221*a* in a confronting relation to the lower convey rollers 222. Both ends of the upper roller shaft 221*a* are held by rock arms 221*b* fitted on a shaft 221*d* supported by the side plates. An eccentric cam 223 is secured to a shaft 223*a* rotated by a motor Mg. The eccentric cam is abutted against an end portion 221*e* of the rock arm 221*b* and serves to rock the rock arm 221*b* between a solid line position (pinching position) and a two dot and chain line position (release position). Incidentally, the upper convey roller 221 and the lower convey roller 222 have the same outer diameter and are rotated at the same peripheral speed in directions shown by the arrows.

Next, the hold arm 230 for holding the rear end portion of the sheet bundle discharged from the convey unit 213 will be explained.

Figure 12:
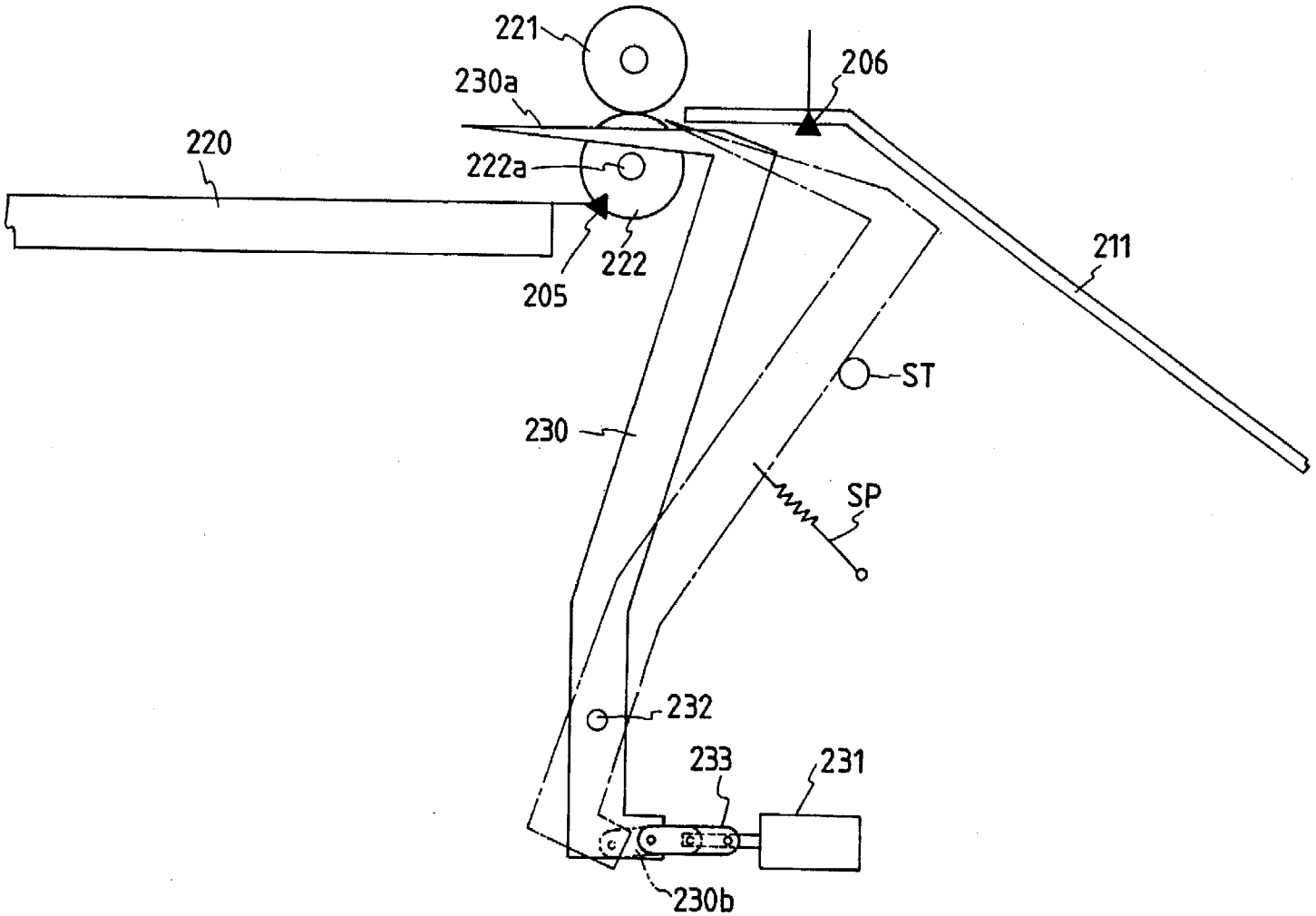
FIG. 12 is an explanatory view showing a holding arm.

As shown in FIG. 12, the hold arm 230 is supported on a support shaft 232 in such a manner that a free end portion 230*a* of the arm to be contacted with a lower surface of the sheet bundle is positioned slightly below nips between the pairs of rollers 221, 222. Further, the other end 230*b* of the hold arm 230 is connected to a solenoid 231 via a connection member 233. Thus, by turning the solenoid 231 ON or OFF, the hold arm 230 can be shifted between an advanced position (shown by the solid line) and a retarded position (shown by the two-dot and chain line). Incidentally, in the advanced position, the free end portion 230*a* of the hold arm protrudes toward a downstream side (left in FIG. 12) of the paired convey rollers 221, 222 so that it is overlapped with the stack tray 220 with a clearance therebetween. On the other hand, in the retarded position, the free end portion 230*a* of the hold arm is shifted at an upstream side of the nips between the paired convey rollers 221, 222.

Next, the construction of the stack tray 220 will be explained.

As shown in FIG. 8, the stack tray 220 is secured to a belt 203 extending between and wound around a lower drive pulley 201 and an upper driven pulley 202, which pulleys are provided on a frame of the stack device 200 which extends in a vertical direction. Thus, the stack tray can be shifted in the vertical direction by rotating the lower pulley 201 by means of a reversible motor Mb. Further, a sensor 204 for detecting a lower limit position of the stack tray 220 arranged on a lower portion of the frame, thereby preventing the stack tray 220 from shifting below the sensor 204.

Further, as shown in FIG. 12, a sheet surface detection sensor 205 is arranged in the proximity of the convey unit 213 of the intermediate unit 210 at a predetermined position. In this way, the motor Mb is controlled so that a distance between the intermediate unit 210 and the surface of the sheet on the stack tray 220 is kept constant by detecting the position of the surface of the sheet on the stack tray 220 by means of the sensor 205. Further, a rear end detection sensor 206 is arranged in the proximity of the lower convey rollers 222 of the intermediate tray 211 and serves to detect the rear end of the sheet bundle conveyed by the paired convey rollers 221, 222, thereby controlling the movements of the convey unit 213 and the hold arm 230.

Further, as shown in FIGS. 8 and 9, a standard plate 235 for aligning a tip end of the sheet bundle conveyed to the stack tray 220 by means of the convey unit 213 extends in a vertical direction and is secured at a downstream side of the stack tray 220. Incidentally, when a distance between the free end of the hold arm 230 and the standard plate 235 under the ON condition of the solenoid 231 is $l_2$ distance between the left side of the lower convey rollers 222 and the standard plate 235 is $l_1$ and a length of the sheet in a conveying direction is l, the standard plate 235 is arranged to satisfy a relation $l_1>l>l_2$ (refer to FIG. 8). And, a control circuit 207 for receiving signals from the sensors and for sending signals to the motors and the solenoid is arranged below the stack device 200 to control the operation.

Figure 13:
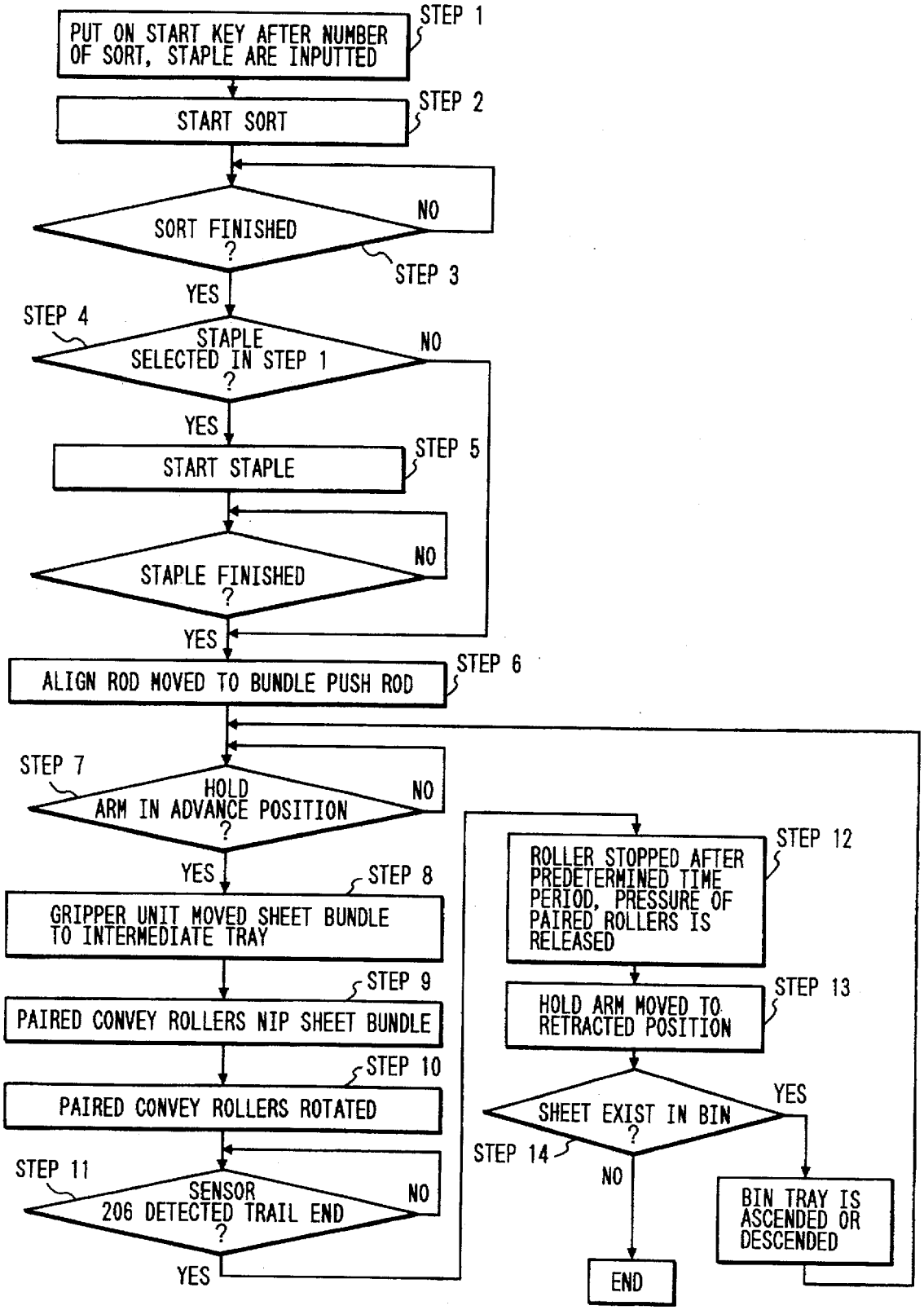
FIG. 13 is a flow chart for explaining an operation.

Next, the operation of the apparatus will be explained with reference to a flow chart shown in FIG. 13.

(Step 1): First of all, the originals are rested on the original stacking plate 321 of the automatic original feed apparatus 320 by an operator. Then, a copy treatment mode (the number of parts to be sorted, staple or non-staple, and the like) is inputted to an operation panel (not shown) of the body 310 of the image forming apparatus. Then, a start key is depressed to initiate the copying operation.

(Steps 2 and 3): The originals are supplied to the platen glass 315 one by one from the automatic original feed apparatus 320. The image forming apparatus 300 discharges the predetermined number of copied sheets set in the step 1, and the sort device 200 sorts, accommodates and aligns the copied sheets in the bin trays as mentioned above. Such operations are effected regarding all of the discharged sheets.

(Step 4): When a sort finish signal is emitted in the step 3, it is judged whether the "staple" is selected or not in the step 1. If not selected, the program goes to a step 6; whereas, if selected, the program goes to a step 5.

Figure 14:
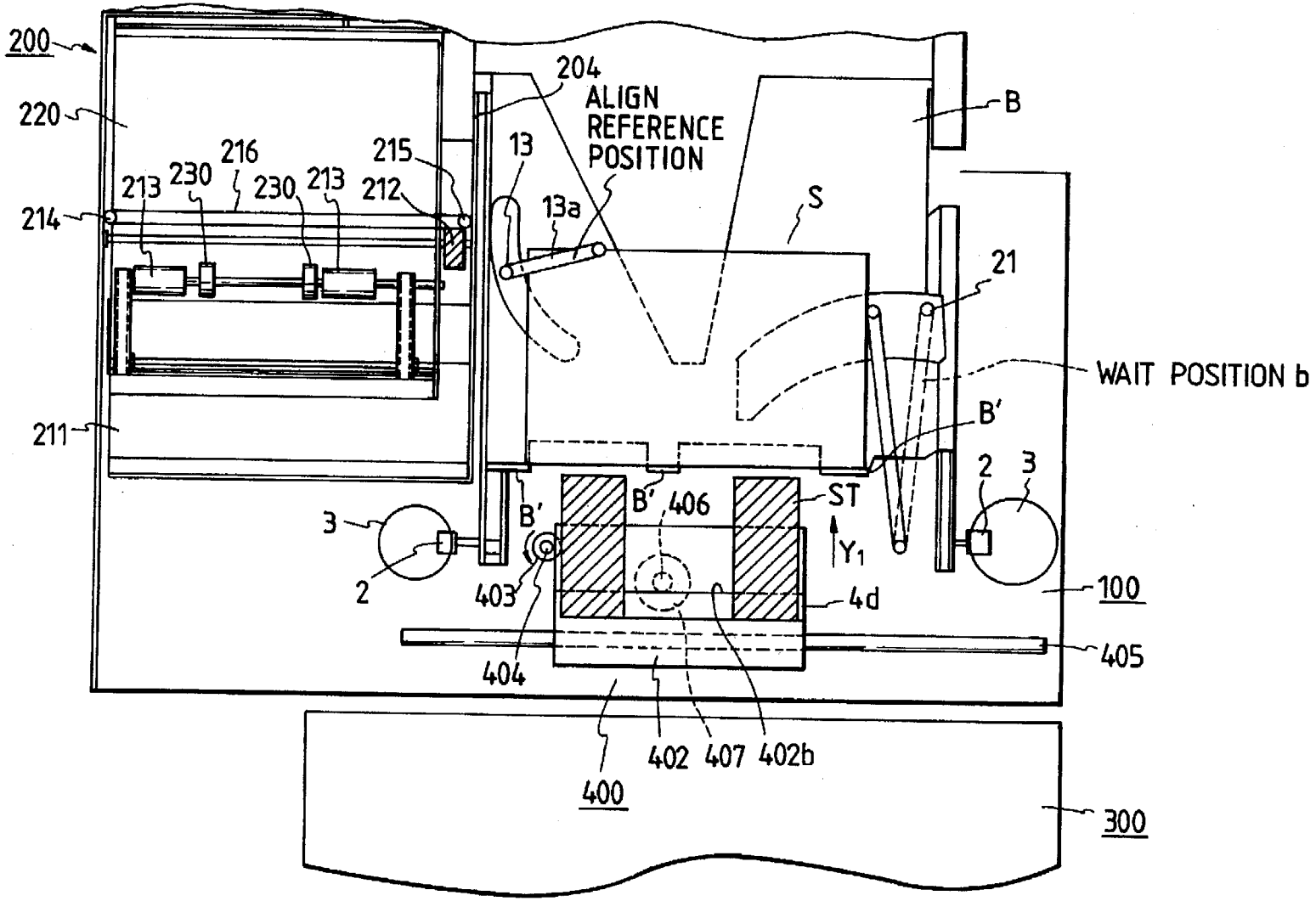
FIGS. 14 and 15 are plan explanatory views for explaining the operation.

(Step 5): During the sorting operation, the first tray 401 having the staplers ST is waiting at a position (FIG. 6) not to interfere with the sheet sorting operation. When all of the sheets are aligned, the bin trays B on which the sheet bundles are rested are shifted, by the rotation of the lifting/lowering rotary members 3, the positions where the bin trays are opposed to the staplers ST. Then, a staple ON signal is sent to the staple unit 400. When this signal is received, the first tray 401 is shifted in the direction shown by the arrow $Y_1$ (see FIG. 14) by the rotation of the pinion gear 404 in the direction shown by the arrow by means of the motor 403. When the first tray 401 is shifted by the predetermined amount to insert the sheet bundle on the bin tray B between the upper jaws $ST_2$ nd lower jaws $ST_1$ of the staplers ST, the sheet bundle is stapled by the clinching operation of the upper and lower jaws $ST_2$, $ST_1$. Then the first tray 401 is returned to the waiting position.

Then, the next bin tray is lifted or lowered by the rotation of the lifting/lowering rotary members 3, and the stapling operation is repeated. In this way, all of the sheet bundles are stapled.

Figure 15:
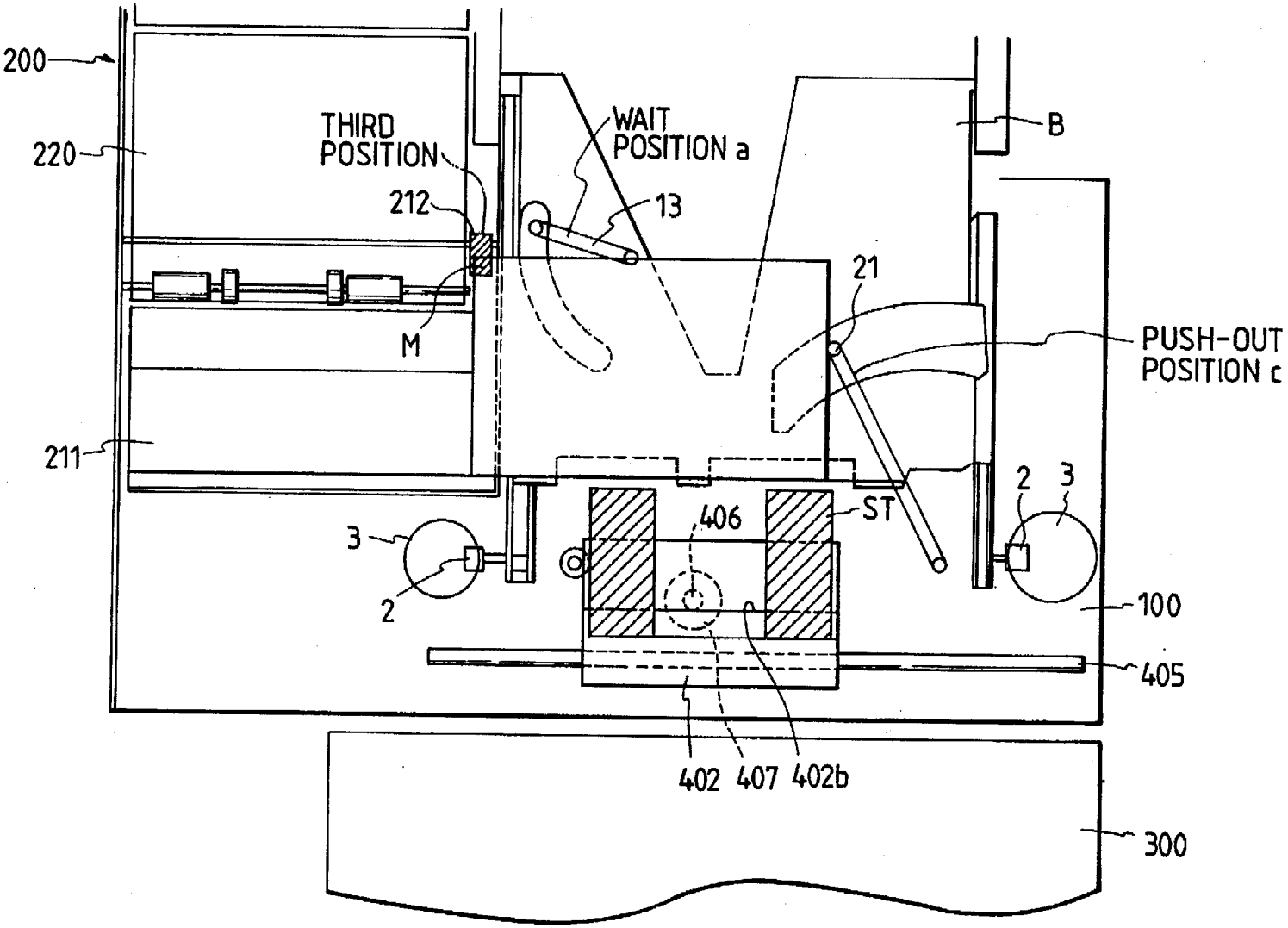
Figure 16:
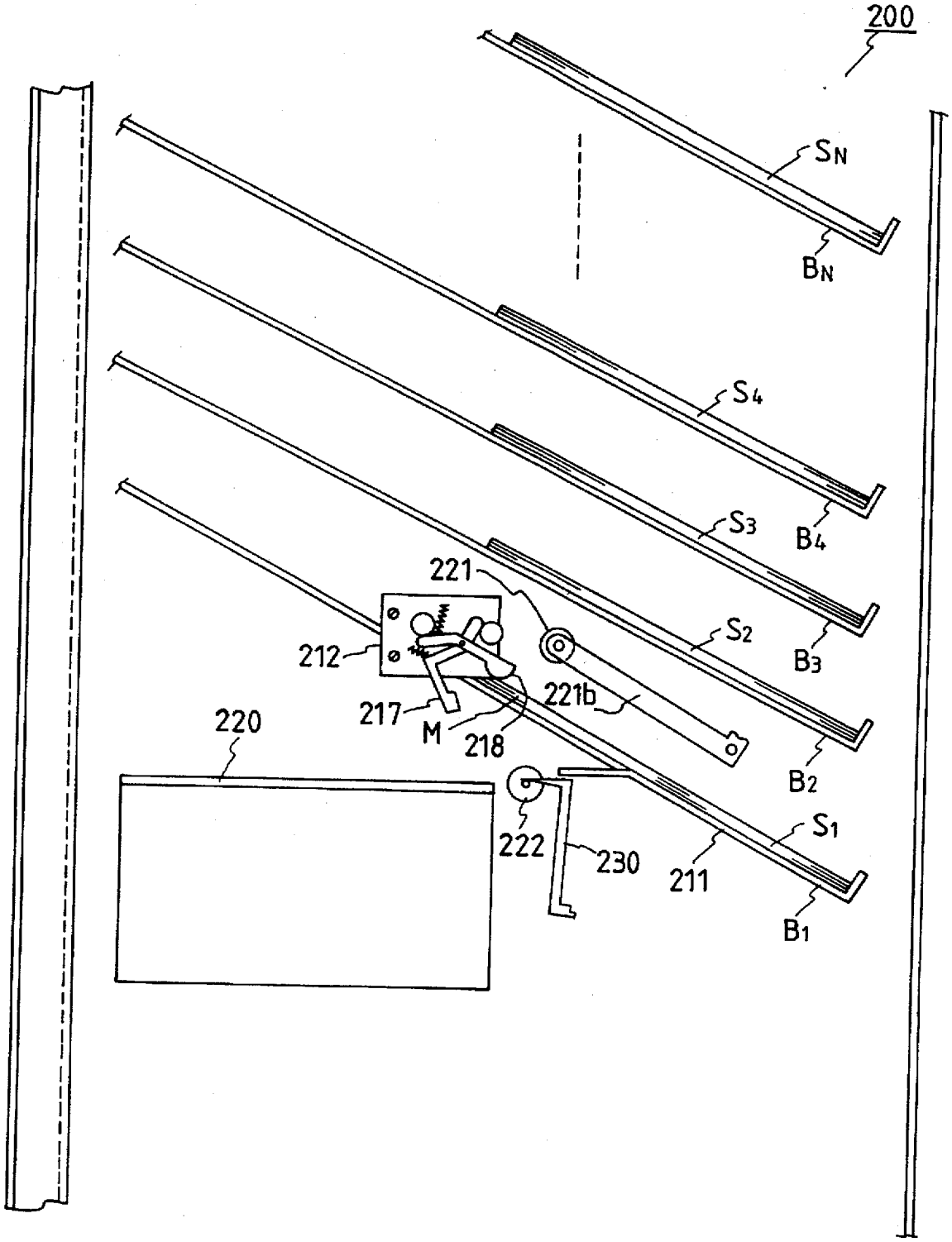
FIGS. 16 and 17 are front explanatory views for explaining the operation.

(Step 6): When the sorting operation and the stapling operation are finished, as shown in FIG. 15, the align standard rod 13 stopped at the align standard position is returned to the wait position a, and then, the align rod 21 is shifted toward an urging position c by means of the pulse motor 19 while abutting against side edges of all of the sheet bundles. By the shifting movement of the align rod 21, the other lateral edges of the sheet bundles are pushed out of the sort device 100 and enter into the stack device 200. In this case, as shown in FIGS. 15 and 16, the gripper unit 212 is positioned at the third position on that side of the stack device 200 in a condition that the lower gripper arm 217 and the upper gripper arm 218 are opened. Thus, when the sheet bundles are pushed out of the sort device, a corner M of the first sheet bundle $S_1$ is inserted between a lower gripper 217 and an upper gripper 218.

(Step 7): Now, it is judged, by the sensor, whether the hold arm 230 is positioned at the advanced position or not. If not, the solenoid 231 is turned ON to shift the hold arm to the advanced position.

Figure 17:
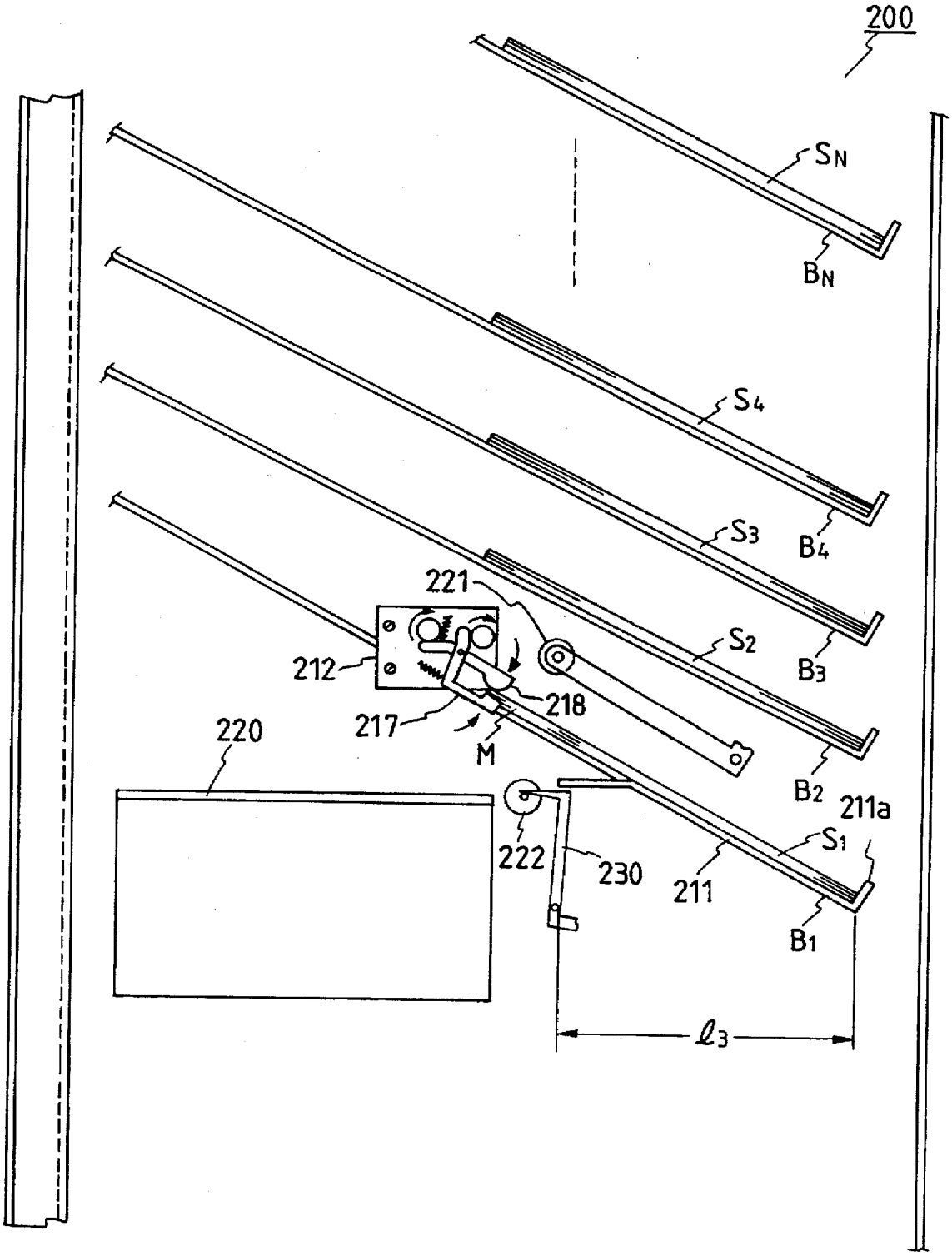

(Step 8): The corner M of the sheet bundle $S_1$ inserted into the gripper unit 212 in the step 6 is surely pinched between the upper and lower gripper arms 217, 218 by the rotations of the eccentric cams 217*a*, 218*a* as mentioned above (refer to FIG. 17). Then, the gripper unit 212 is shifted toward this side by the motor Md while pinching the sheet bundle $S_1$. In this case, the upper convey rollers 221 are supported by the rock arm 221*b* and are separated from the lower convey rollers 222. Accordingly, the sheet bundle $S_1$ is inserted between the upper convey rollers and the lower convey rollers.

Figure 18:
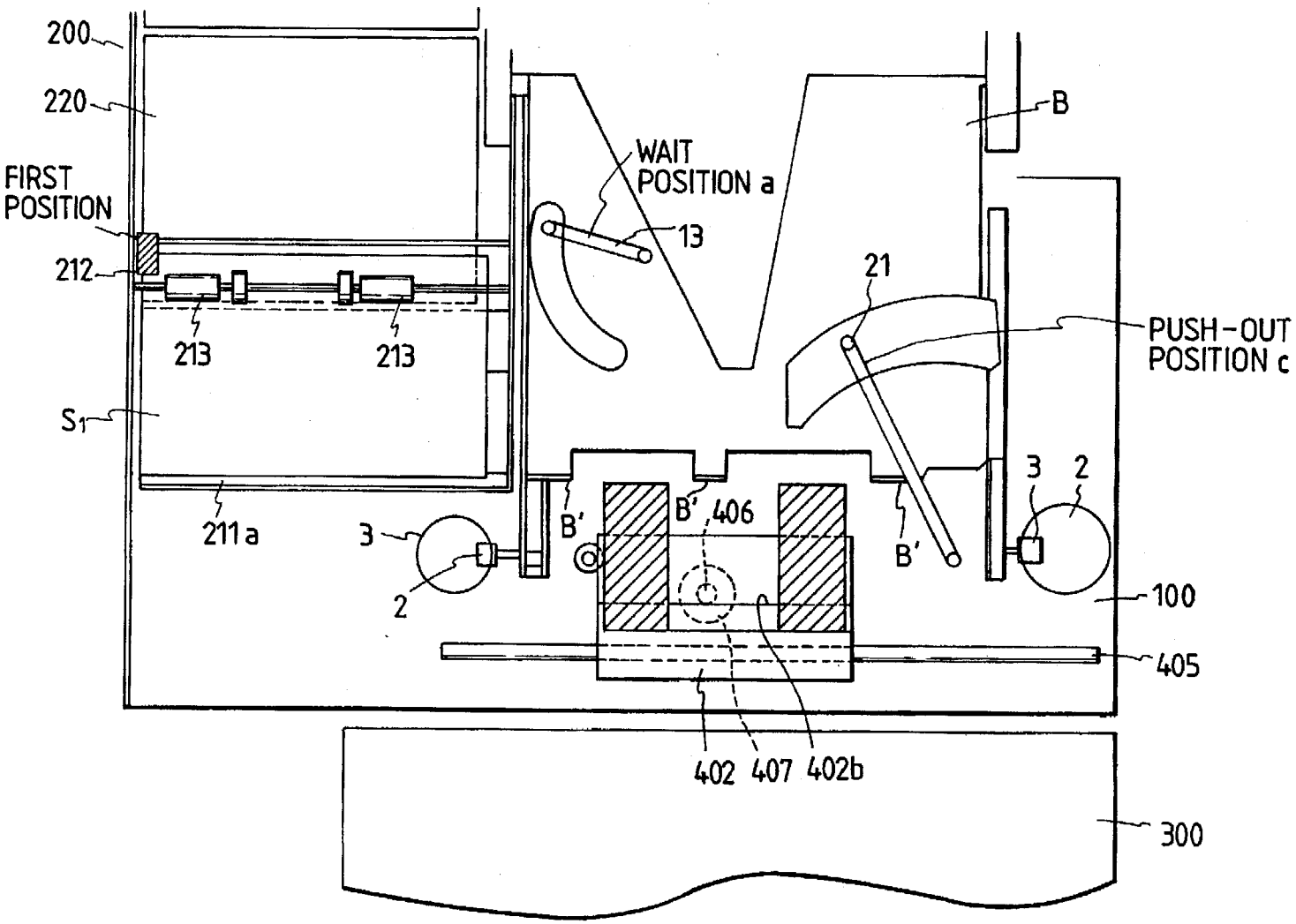
FIG. 18 is a plan explanatory view for explaining the operation.

During the above conveying operation, since the corner M of the sheet bundle $S_1$ is surely pinched between and held by the upper and lower gripper arms and a rear end portion of the sheet bundle is guided by the rear end stopper B' of the bin tray B and the rear end stopper 211*a* of the intermediate tray 211, which stoppers are positioned in flush with each other, the sheets in the sheet bundle are not deviated from each other. As shown in FIG. 18, the gripper unit 212 is shifted to the first position where the sheet bundle $S_1$ is completely rested on the intermediate tray 211, the gripper unit is stopped, and the eccentric cams 217*a*, 218*a* are rotated again to release the pinching of the sheet bundle (tip end), thereby dropping the sheet bundle. Since the tip end of the sheet bundle is received by the hold arm 230 which is now waiting below the sheet bundle, the shock due to the dropping is relieved, thereby preventing the deviation of the sheets in the sheet bundle.

In the apparatus according to the illustrated embodiment, in order to make the apparatus compact, a length $l_3$ (FIG. 17) of the intermediate tray 211 is selected to be smaller than the length l of the sheet by a predetermined amount. However, the free end portion 230*a* of the hold arm 230 also acts as an extension of the intermediate tray 211, thereby achieving the compactness of the apparatus without worsening the stacking ability.

Figure 19:
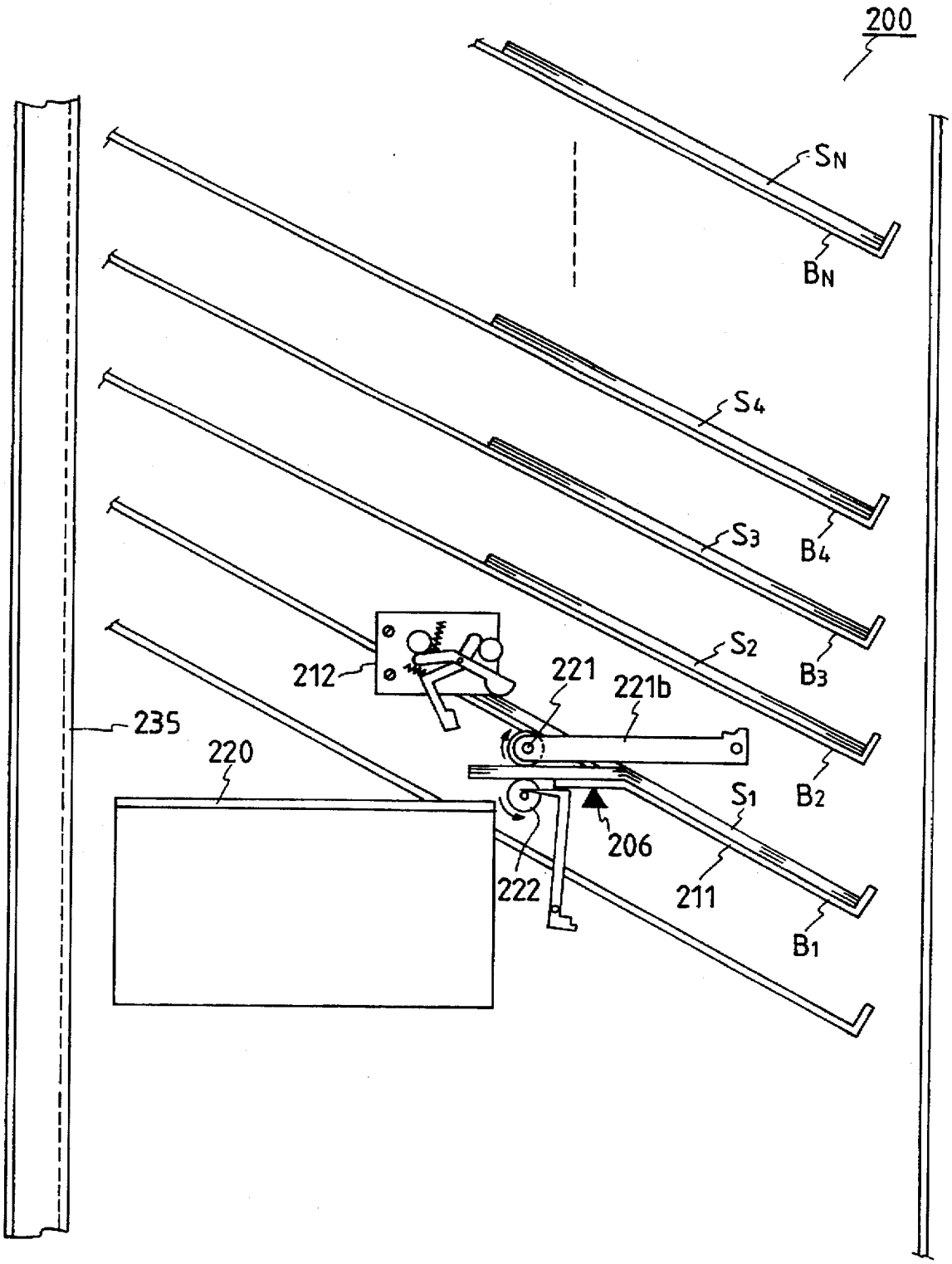
FIGS. 19 to 22 are front explanatory views for explaining the operation.

(Step 9): Then, the convey rollers 221 supported by the rock arm 221*b* of the convey unit 213 are rocked, by the motor Mg, to a position where the sheet bundle $S_1$ is pinched between the lower convey rollers 222 and the upper convey rollers 221 (FIG. 19).

Figure 20:
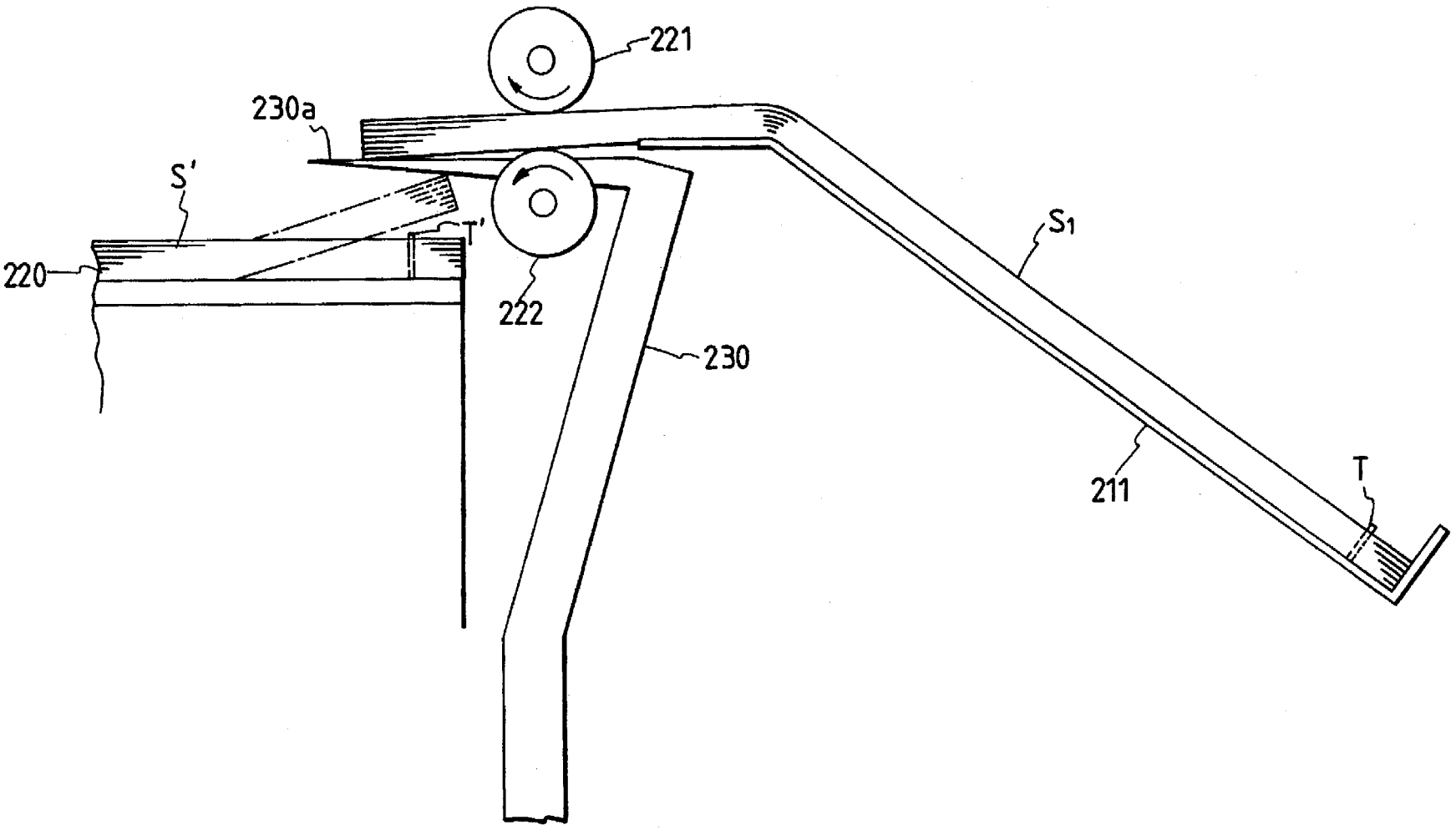

(Step 10): When the predetermined pinching force is applied to the upper convey rollers 222 and the lower convey rollers 221, the convey rollers are rotated by the motor Mf in the direction shown by the arrows at the same peripheral speed to convey the sheet bundle $S_1$. As shown in FIG. 20, even when a previous sheet bundle S' has already been rested on the stack tray 220 and the sheet bundle S' is stapled by staples T' or the sheet bundle S' is curled (as shown by the phantom line), since the hold arm 230 is positioned between the rear end portion of the sheet bundle S' and the tip end portion of the sheet bundle $S_1$ to separate the sheet bundles from each other, the sheet bundle $S_1$ can be shifted by the rotations of the convey rollers in a condition that the tip end of the sheet bundle $S_1$ is not caught by any obstacle.

Figure 21:
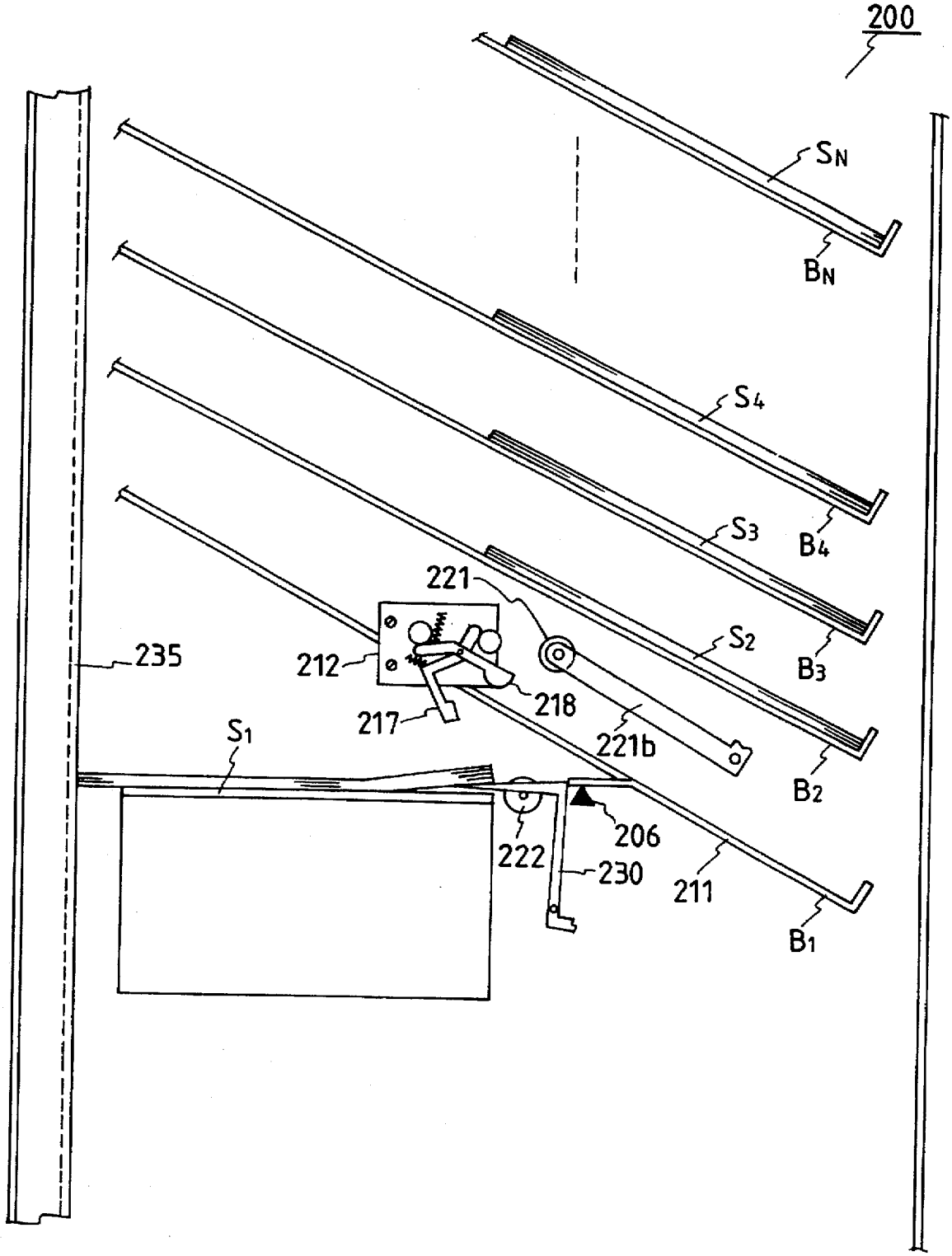

(Steps 11 and 12): After the rear end of the sheet bundle $S_1$ is detected by the sensor 206, the convey rollers continue to be rotated by a timer until the rear end of the sheet bundle leaves the convey rollers. As shown in FIG. 21, the tip end of the discharged sheet bundle $S_1$ is regulated by the standard plate 235 by its own weight, and the rear end portion of the sheet bundle is supported by the hold arm 230. As shown in FIG. 20, even when the rear end portion of the sheet bundle $S_1$ is stapled by the staples T, since the staples T are separated from a previously stacked sheet bundle $S_1$ with the interposition of the hold arm 230, the poor stacking does not occur. When the convey rollers are stopped, the upper convey rollers are rocked by driving the motor Mg again to be shifted to the release position.

Figure 22:
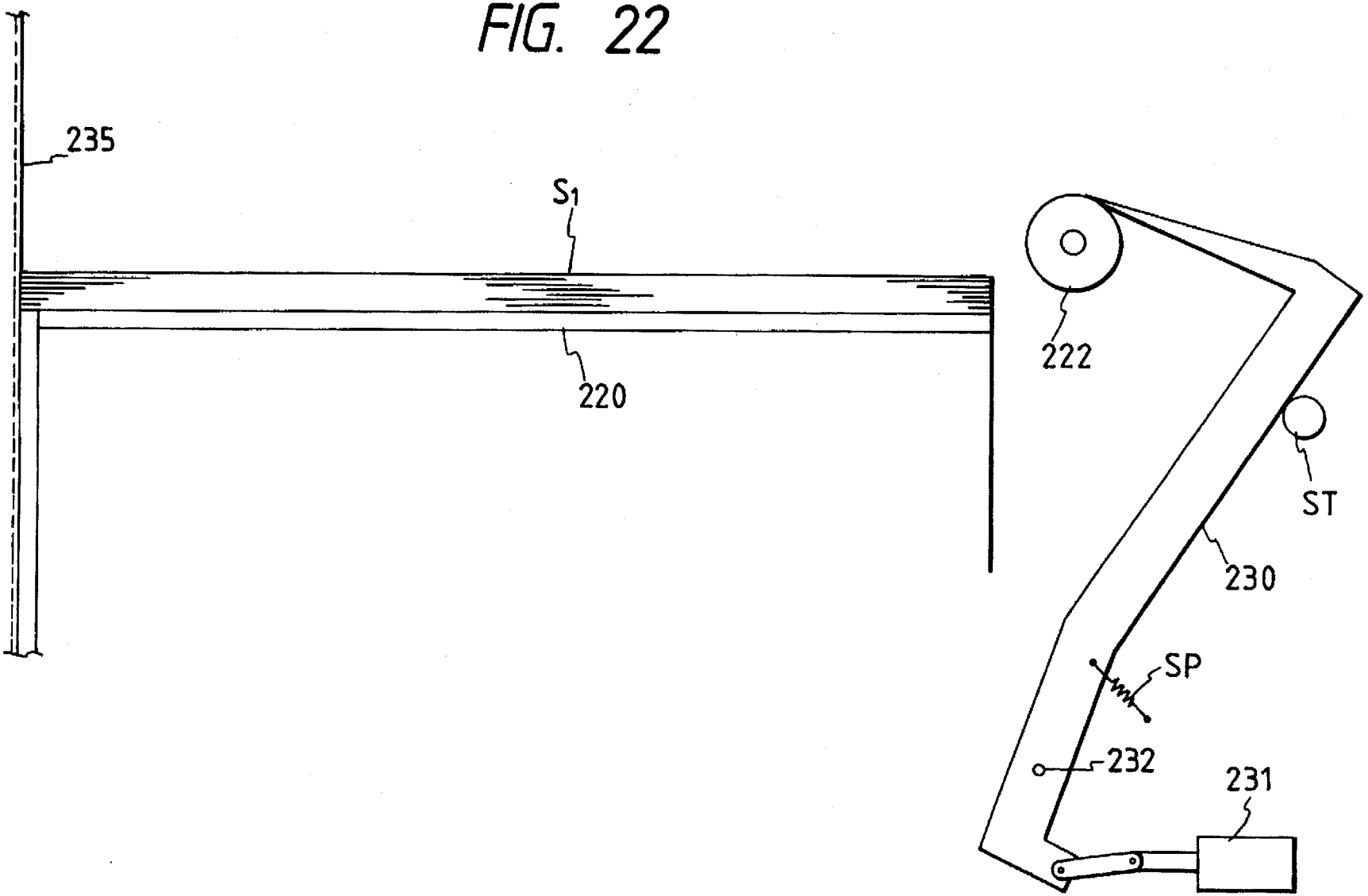

(Step 13): Then, the solenoid 231 is turned OFF in response to a shift start signal for shifting the convey rollers to the release position, with the result that the hold arm 230 is shifted to the retarded position by a spring SP and then is stopped by a stopper pin ST (FIG. 22). During this operation, since the rear end portion of the sheet bundle $S_1$ is dropped calmly while regulating the tip end of the sheet bundle by the standard plate 235 the aligned condition is not distorted.

By the operations from the step 6 to the step 13, the single sheet bundle is conveyed from the bin tray B to the stack tray 220 while maintaining the aligned condition.

(Step 14): When the step 13 is finished, it is judged whether there are the sheets in the bin trays of the sort device 100. If there are the sheets, the bin tray B containing the sheets is shifted to the position where the bin tray is opposed to the intermediate tray 210, and the operations in the step 7 and so on are repeated. On the other hand, if there is no sheet, the program is ended. Incidentally, in the step 13, the shifting movement of the hold arm 230 to the retract position upon the turning OFF of the solenoid 231 may be started before the sheet bundle is discharged from the convey rollers so long as the staples on the sheet bundle rides over the rear end of the sheet bundle rested on the stack tray.

(Other Embodiments)

Figure 23:
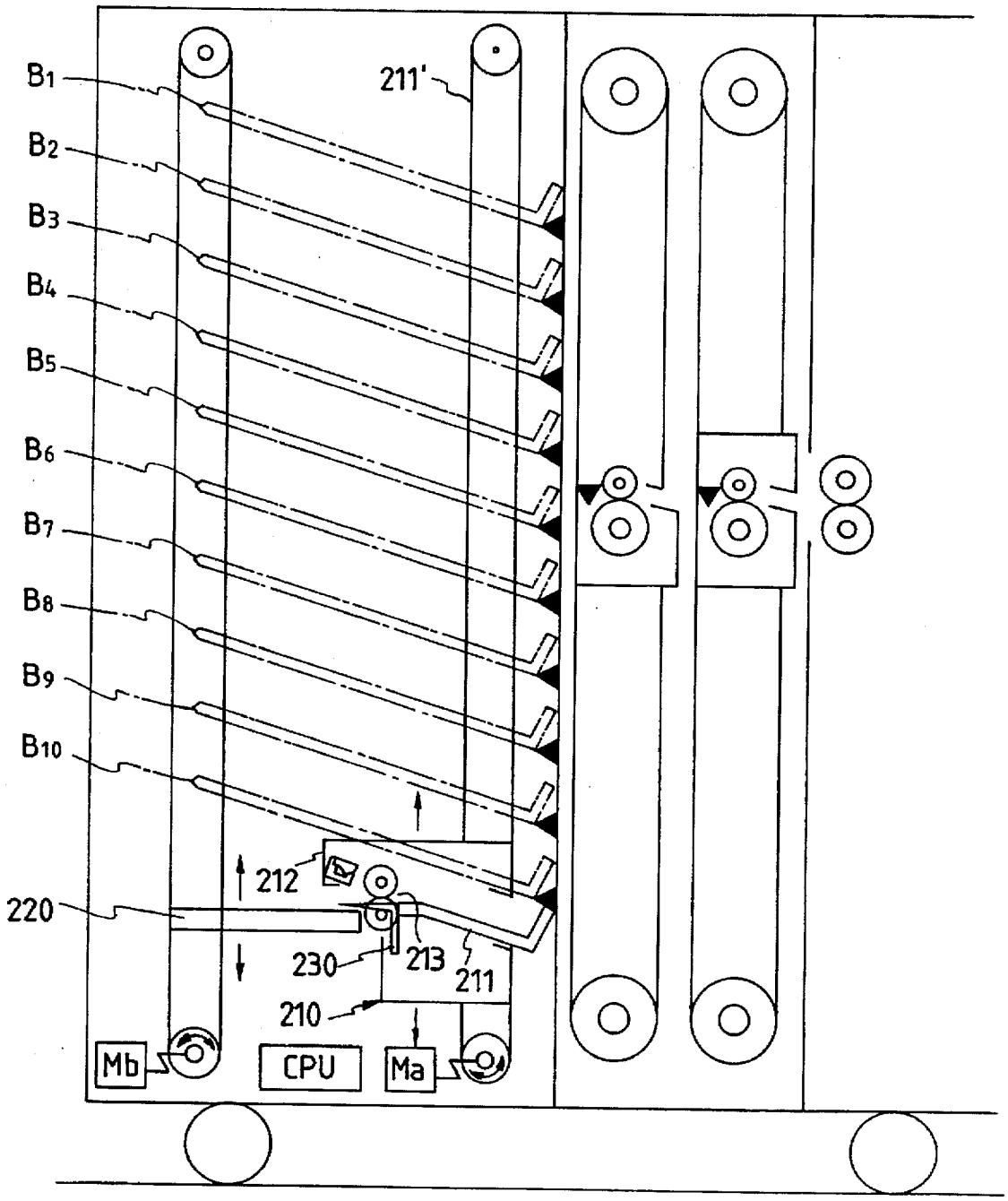
FIG. 23 is a front view showing a second embodiment of the present invention.

While the sort device according to the aforementioned embodiment was of bin shift type wherein the bin unit itself is shifted with respect to the discharge opening to sort the sheets, the bin unit may be stationary and the discharge opening may be shifted to sort the sheets (bin stationary type). In this case, as shown in FIG. 23, there is provided a lifting/lowering means 211' capable of shifting the intermediate unit 210 to positions where the intermediate unit is opposed to one of the stationary bin trays B. Also in this case, the shifting movement of the sheet bundle is the same as that of the aforementioned embodiment.

Next, an embodiment wherein the hold arm 230 and the upper convey rollers 221 are rocked by the same single drive source will be explained. Incidentally, in this embodiment, since the fundamental construction and operation of the apparatus are the same as those in the aforementioned embodiment, the same constructural elements as those of the aforementioned embodiment are designated by the same reference numerals and explanation thereof will be omitted.

Figure 24A:
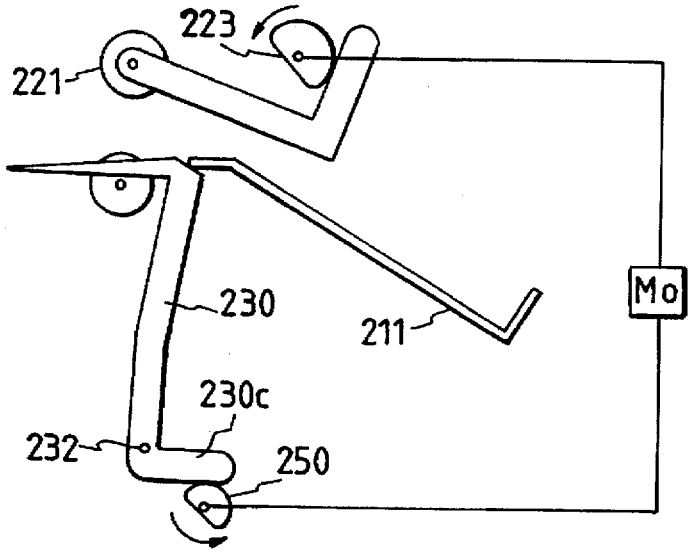
FIGS. 24A to 24C are front explanatory views for explaining an operation regarding a third embodiment of the present invention.
Figure 24B:
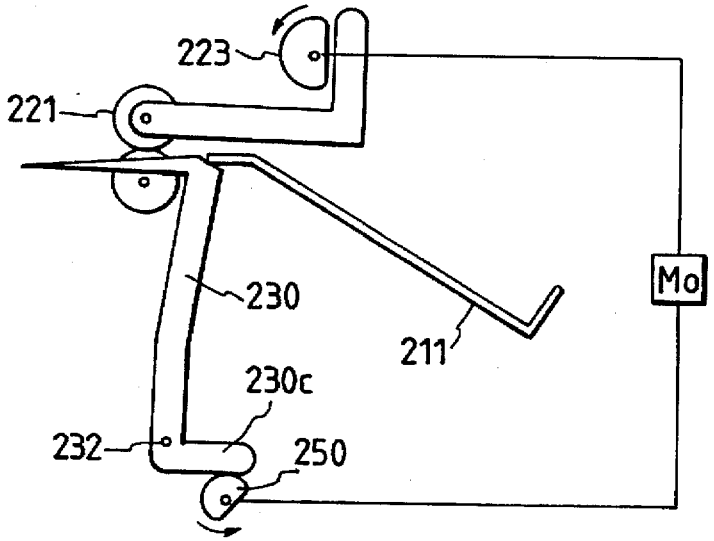
Figure 24C:
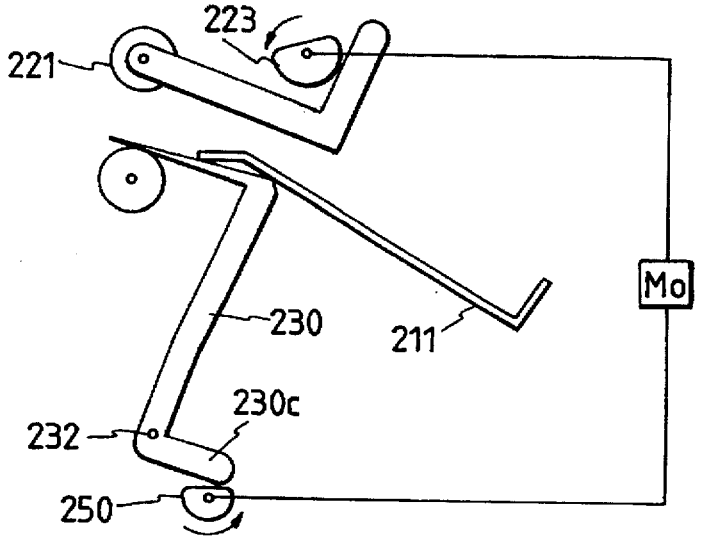

As shown in FIGS. 24A to 24C, the apparatus according to this embodiment includes an eccentric cam 250 abutted against one end 230*c* of the hold arm 230 and adapted to rock the hold arm around a shaft 232. The eccentric cam 250 is connected to a motor Mo for rocking the upper convey rollers 221 and is designed so that the cam is rotated by one revolution in synchronous with one revolution of the eccentric cam 223. The eccentric cams 223, 250 are rotated in directions shown by the arrows to assume positions shown in FIG. 24A→FIG. 24B→FIG. 24C→FIG. 24A, repeatedly. FIG. 24A corresponds to the operation in the step 7, FIG. 24B corresponds to the operations in the steps 8 to 11, and FIG. 24C corresponds to the operations in the steps 12 and 13. And, such operations are the same as those of the aforementioned embodiment.

Figure 25:
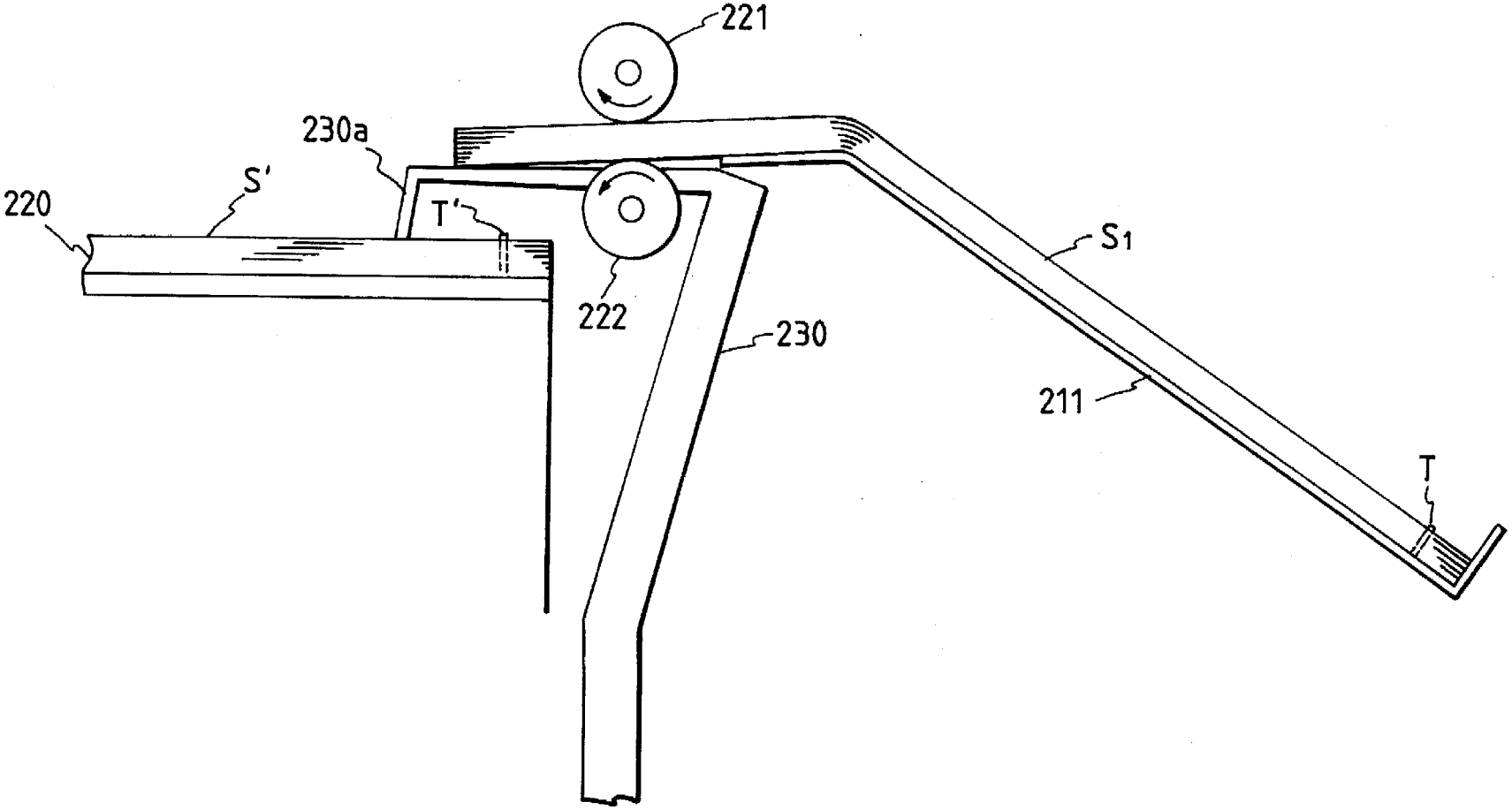
FIG. 25 is an enlarged front view showing a fourth embodiment of the present invention.

As mentioned above, in this embodiment, one of the drive solenoids can be eliminated, thereby making the apparatus cheaper and more compact. Further, as shown in FIG. 25, by abutting the tip end 230*a* of the hold arm against the upper surface of the sheet bundle S' already rested on the stack tray 220, it is possible to prevent the aligned condition of the sheet bundle S' from being distorted.

Figure 26:
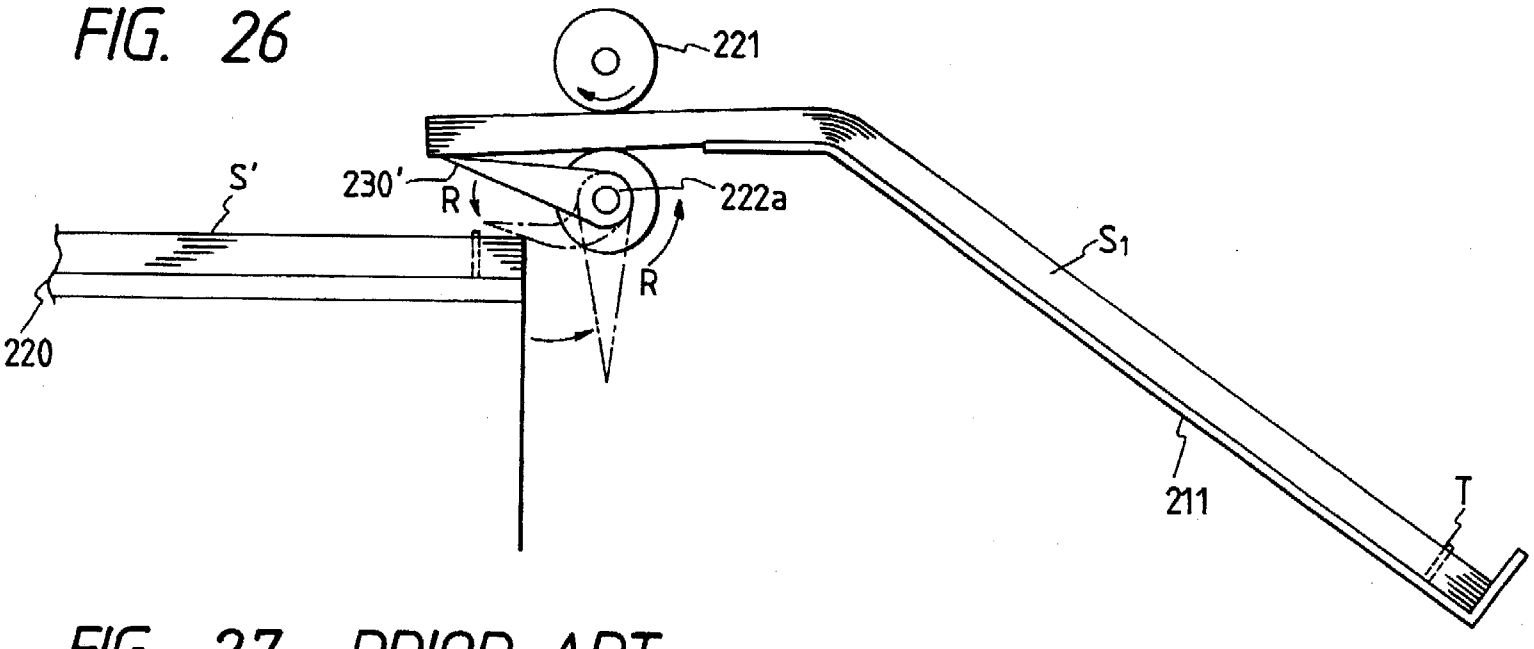
FIG. 26 is an enlarged front view showing a fifth embodiment of the present invention.
Figure 27:
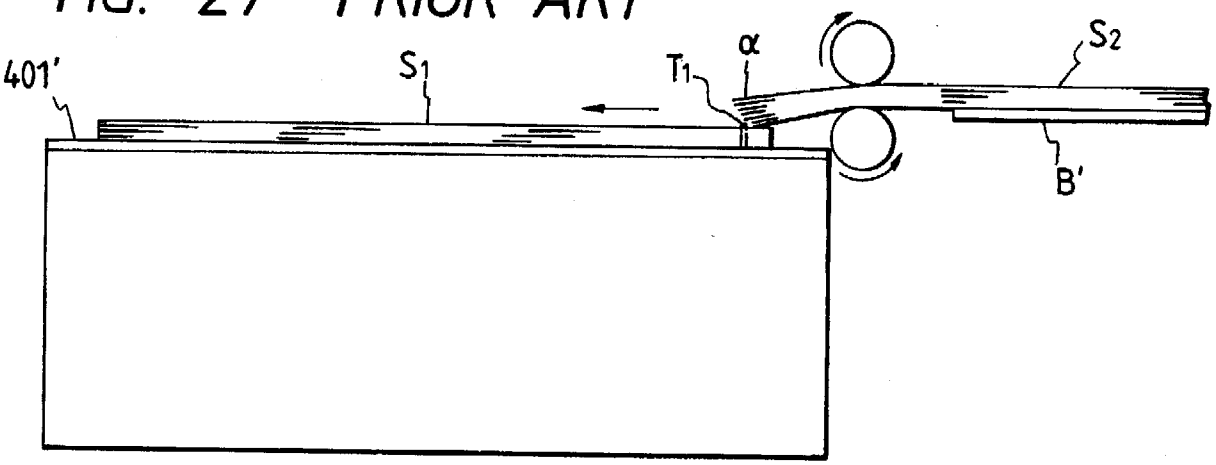
FIG. 27 PRIOR ART
FIGS. 27 to 29 are front views for a conventional sheet post-treatment apparatus.
Figure 28:
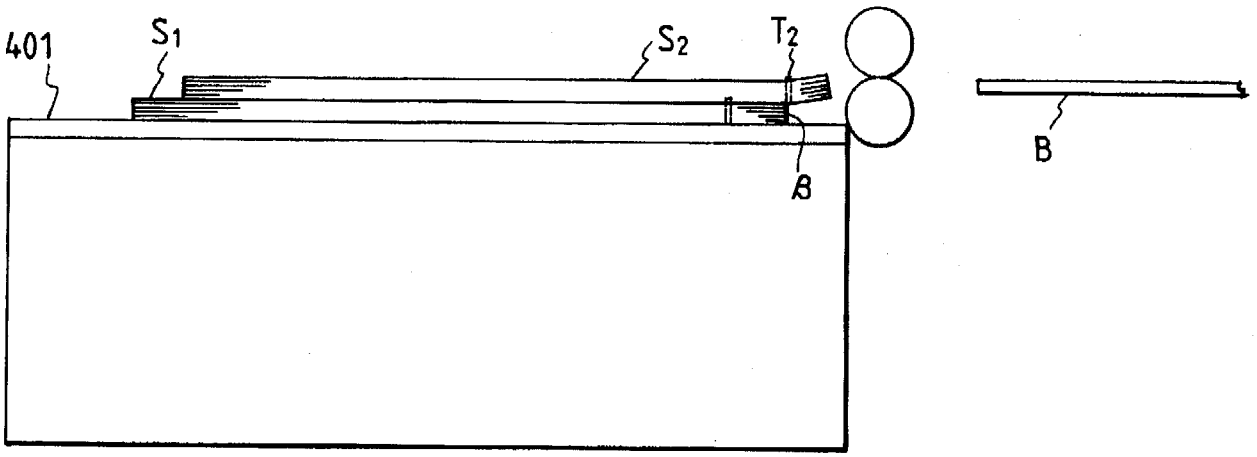
FIG. 28 PRIOR ART
Figure 29:
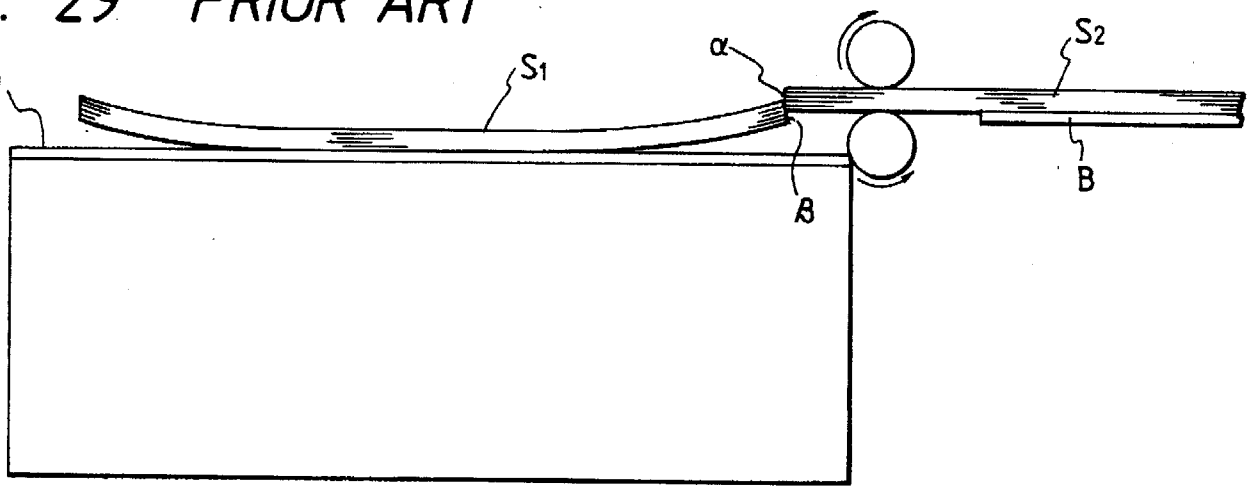
FIG. 29 PRIOR ART

In the above-mentioned embodiments, while an example that the hold arm 230 is rocked around the shaft to be advanced or retracted was explained, as shown in FIG. 26, the hold arm 230 may be made of elastic material and may be advanced or retarded by rotating the shaft. In this embodiment, the hold arm 230 is rotated by a driving force R around a shaft 222*a* to the solid line position→the dot and chain position→the two-dot and chain position→the solid line position in order.

Incidentally, in the above-mentioned embodiments, while an example that the hold arm is retracted in a direction opposite to a sheet conveying direction was explained, the present invention is not limited to this example, but the hold arm may be retracted in the same direction as the sheet conveying direction or in a direction perpendicular to the sheet conveying direction.

What is claimed is:

1. A sheet post-treatment apparatus comprising:

sheet receiving tray means including a plurality of bin trays and an intermediate tray;

convey means for conveying a sheet in the bin trays to the intermediate tray;

sheet bundle convey means including conveving means for conveying the sheet, and a sheet stacking tray for receiving and stacking sheets thereon, wherein the plurality of bin trays are capable of being lifted or lowered, and said conveying means conveys a sheet from the intermediate tray to the sheet stacking tray; and a hold member that shifts generally in a convey direction of the sheet by said conveying means between a first position where said hold member is overlapped with a stacking surface of said sheet stacking tray above said stacking surface and a second position where said hold member is retracted from said stacking surface, said hold member being a lever member made of an elastic material and rotatable in the sheet convey direction of said conveying means, said lever member being rotated to the first position in advance to support a tip end of the sheet to be stacked, and when the sheet is thereafter conveyed to a stack position by said conveying means, said lever member being rotated to be abutted onto the preceding sheet stack and being shifted to the second position while bending, whereby the trailing end of the stacked sheets is dropped onto the preceding sheet.

2. A sheet post-treatment apparatus comprising:

sheet receiving tray means including a plurality of bin trays and an intermediate tray;

Convey means for conveying the sheet in the plurality of bin trays to the intermediate tray;

sheet bundle convey means including conveying means for conveying a sheet and a sheet stacking tray for receiving and stacking the sheets thereon, the intermediate tray capable of being lifted and lowered, and a hold member that shifts generally in a convey direction of the sheet by said conveying means between a first position where said hold member is overlapped with a stacking surface of said sheet stacking tray and a second position where said hold member is retracted from said stacking surface, said hold member being shifted to the first position in advance to support a tip end of the sheet to be stacked, and when the sheet is thereafter conveyed to a stack position by said conveying means, said hold member being shifted to the second position to drop a trailing end of the stacked sheet, and when the sheet is stacked on said sheet stacking tray, said sheet stacking tray being shifted in a vertical direction by a predetermined amount, and said hold member being returned to the first position.

3. A sheet post-treatment apparatus according to claim 2, wherein said hold member is a lever member rockable between the first and second positions, and a free end of said lever extending in the convey direction of said conveying means is separated from a surface of a preceding sheet at the first position.

4. A sheet post-treatment apparatus according to claim 2, wherein said hold member is a lever member rockable between the first and second positions, and a free end of said lever extending in the convey direction of said conveying means is rested on a surface of a preceding sheet at the first position.

5. A sheet post-treatment apparatus according to claim 2, further comprising post-treatment means for stapling the sheets on said sheet receiving tray means, wherein the stapled sheets are conveyed to the sheet stacking tray.

6. A sheet post-treatment apparatus according to claim 2, wherein said conveying means is a pair of rollers to be abutted against each other or separated away from each other, and said hold member shifts in synchronous with the abutment/separation operation.

7. A sheet post-treatment apparatus according to claim 2, wherein said sheet stacking tray stacks the sheets while descending gradually in accordance with a stacking amount of the sheets.

8. A sheet post-treatment apparatus comprising:

sheet receiving tray means including a plurality of bin trays and an intermediate tray;

convey means for conveying the sheet in the plurality of bin trays to the intermediate tray;

sheet bundle convey means including conveying means for conveying sheets and a sheet stacking tray for receiving and stacking the sheets thereon, the plurality of bin trays capable of being lifted and lowered, and wherein said conveying means conveys the sheet from said intermediate tray to said sheet stacking tray; and a hold member that shifts generally in a convey direction of the sheet by said conveying means between a first position where said hold member is overlapped with a stacking surface of said sheet stacking tray and a second position where said hold member is retracted from said stacking surface, said hold member being shifted to the first position in advance to support a tip end of the sheet to be stacked, and when the sheet is thereafter conveyed to a stack position by said conveying means, said hold member being shifted to said second position to drop a trailing end of the stacked sheet, and when the sheet is stacked on said sheet stacking tray said sheet stacking tray being shifted in a vertical direction by a predetermined amount, and said hold member being returned to said first position.

9. A sheet post-treatment apparatus according to claim 8, further comprising post-treatment means for stapling the sheets on said sheet receiving tray means, wherein the stapled sheets are conveyed to the sheet stacking tray.

10. A sheet post-treatment apparatus according to claim 8, wherein said conveying means is a pair of rollers to be abutted against each other or separated away from each other, and said hold member shifts in synchronous with the abutment/separation operation.

11. A sheet post-treatment apparatus according to claim 8, further comprising timing means for timing between the abutment/separation operation of said rotatable member and the shift of said hold member.

12. A sheet post-treatment apparatus according to claim 10, wherein said hold member is a lever member rockable between the first and second positions, and a free end of said lever extending in the convey direction of said conveying means is separated from a surface of a preceding sheet at the first position.

13. A sheet post-treatment apparatus according to claim 10, wherein said hold member is a lever member rockable between the first and second positions, and a free end of said lever extending in the convey direction of said conveying means is rested on a surface of a preceding sheet at the first position.

14. A sheet post-treatment apparatus according to claim 8, wherein said sheet stacking tray stacks the sheets while descending gradually in accordance with a stacking amount of the sheets.

15. A sheet post-treatment apparatus according to claim 8, wherein said hold member is a lever member rocked between the first and second positions, and a free end of said lever extending in the convey direction is separated from a surface of a preceding sheet at the first position.

16. A sheet post-treatment apparatus according to claim 8, wherein said hold member is a lever member rocked between the first and second positions, and a free end of said lever extending in the convey direction is rested on a surface of a preceding sheet at the first position.

17. An image forming apparatus comprising:

an image forming portion; and a sheet post-treatment apparatus, said sheet post-treatment apparatus comprising sheet receiving tray means including a plurality of bin trays and an intermediate tray;

convey means for conveying a sheet in the plurality of bin trays to the intermediate tray;

sheet bundle convey means including conveying means for conveying the sheet and a sheet stacking tray for receiving and stacking sheets thereon, the plurality of bin trays capable of being lifted and lowered, and wherein said conveying means conveys the sheet from said intermediate tray to said sheet stacking tray; and a hold member that shifts generally in a convey direction of the sheet by said conveving means between a first position where said hold member is overlapped with a stacking surface of said sheet stacking tray and a second position where said hold member is retracted from said stacking surface, said hold member being shifted to the first position in advance to support a tip end of the sheet to be stacked, and when the sheet is thereafter conveyed to a stack position by said conveying means, said hold member being shifted to said second position to drop a trailing end of the stacked sheet, and when the sheet is stacked on said sheet stacking tray, said sheet stacking tray being shifted in a vertical direction by a predetermined amount, and said hold member being returned to said first position.

18. An image forming apparatus comprising:

an image forming portion; and a sheet post-treatment apparatus, said sheet post-treatment apparatus comprising:

sheet receiving tray means including a plurality of bin trays and an intermediate tray;

convey means for conveying a sheet in the bin trays to the intermediate tray;

sheet bundle convey means including conveying means for conveying a sheet, and a sheet stacking tray for receiving and stacking sheets thereon, wherein the plurality of bin trays are capable of being lifted or lowered, and said conveying means conveys a sheet from the intermediate tray to the sheet stacking tray; and a hold member that shifts generally in a convey direction of the sheet by said conveying means between a first position where said hold member is overlapped with a stacking surface of said sheet stacking tray above said stacking surface and a second position where said hold member is retracted from said stacking surface, said hold member being a lever member made of a plastic material and rotatable in the sheet convey direction of said conveying means, said lever member being rotated to the first position in advance to support a tip end of the sheet to be stacked, and when the sheet is thereafter conveyed to a stack position by said conveying means, said lever member being rotated to be abutted onto the preceding sheet stack and being shifted to the second position while bending, whereby the trailing end of the stacked sheets is dropped onto the preceding sheet.

19. An image forming apparatus, comprising:

an image forming portion; and a sheet post-treatment apparatus, said sheet post-treatment apparatus comprising:

sheet receiving tray means including a plurality of bin trays and an intermediate tray;

convey means for conveying a sheet in the plurality of bin trays to the intermediate tray;

sheet bundle convey means including conveying means for conveying a sheet and a sheet stacking tray for receiving and stacking sheets thereon, the intermediate tray capable of being lifted and lowered, and a hold member that shifts generally in a convey direction of the sheet by said conveying means between a first position where said hold member is overlapped with a stacking surface of said sheet stacking tray and a second position where said hold member is retracted from said stacking surface, said hold member being shifted to the first position in advance to support a tip end of the sheet to be stacked, and when the sheet is thereafter conveyed to a stack position by said conveying means, said hold member being shifted to the second position to drop a trailing end of the stacked sheet, and when the sheet is stacked on said sheet stacking tray, said sheet stacking tray being shifted in a vertical direction by a predetermined amount, and said hold member being returned to the first position.

20. A sheet post-treatment apparatus comprising:

sheet receiving tray means including a plurality of bin trays and an intermediate tray;

convey means for conveying a sheet in the plurality of bin trays to the intermediate tray;

sheet bundle convey means including conveying means for conveying a sheet and a sheet stacking tray for receiving and stacking sheets thereon, the plurality of bin trays being capable of being lifted and lowered, and wherein said conveying means conveys a sheet from the intermediate tray to the sheet stacking tray; and a hold member that shifts generally in a convey direction of the sheet by said conveying means between a first position where said hold member is overlapped with a stacking surface of said sheet stacking tray above the stacking surface and a second position where said hold member is retracted from said stacking surface, said hold member being a lever member made of an elastic material and rotatable in the sheet convey direction of said conveying means, said lever member being rotated to the first position in advance to support a tip end of the sheet to be stacked, and when the sheet is thereafter conveyed to a stack position by said conveying means, said lever member being rotated to be abutted on to the preceding sheet stack and being shifted to the second position while bending, whereby the trailing end of the stacked sheet is dropped onto the preceding sheet.

* * * * *

UNITED STATES PATENT AND TRADEMARK OFFICE

CERTIFICATE OF CORRECTION

PATENT NO. : 5,678,818

DATED : October 21, 1997

INVENTOR(S) : HAYASHI ET AL.

It is certified that error appears in the above-identified patent and that said Letters Patent is hereby corrected as shown below: TITLE PAGE:

At [56] References Cited

"63-267667 4/1988 Japan" should read --63-267667 11/1988 Japan--; and
"4-146674 6/1989 Japan" should read --4-146674 6/1989 Japan--.

Column 1

Line 62, "regarding" should read --regarding a--.

Column 3

Line 51, "a" (first occurrence) should be deleted.

Column 4

Line 19, "19a a" should read --19a--;
Line 24, "arm 15a a" should read --arm 15a--; and
Line 40, "arm 15a a" should read --arm 15a--.

Column 5

Line 46, "extend" should read --extended--.

Column 7

Line 66, "nd" should read --and--.

Column 9

Line 50, "rides" should read --ride--.

UNITED STATES PATENT AND TRADEMARK OFFICE

CERTIFICATE OF CORRECTION

PATENT NO. : 5,678,818

DATED : October 21, 1997

INVENTOR(S) : HAYASHI ET AL.

It is certified that error appears in the above-identified patent and that said Letters Patent is hereby corrected as shown below:

Column 10

Line 11, "synchronous" should read --synchronism--; and
Line 53, "a" should read --the--.

Column 11

Line 10, "Convey" should read --convey--, and "the sheet" should read --a sheet--;
Line 13, "a sheet and" should read --the sheet and--;
Line 15, "lowered," should read --lowered;--;
Line 50, "synchronous" should read --synchronism--;
Line 59, "the sheet" should read --a sheet--; and
Line 62, "sheets" should read --the sheet--.

Column 12

Line 12, "tray said" should read --tray, said--;
Line 22, "synchronous" should read --synchronism--;
Line 24, "claim 8," should read --claim 10,--; and
Line 56, "comprising" should read --comprising:--.

Column 13

Line 26, "a sheet" should read --the sheet--; and
Line 42, "lever" should read --lever--.

UNITED STATES PATENT AND TRADEMARK OFFICE

CERTIFICATE OF CORRECTION

PATENT NO. : 5,678,818 Page 3 of 3

DATED : October 21, 1997

INVENTOR(S) : HAYASHI ET AL.

It is certified that error appears in the above-identified patent and that said Letters Patent is hereby corrected as shown below:

Column 14

Line 6, "a sheet and" should read --the sheet and--;
Line 8, "lowered," should read --lowered;--;
Line 32, "a sheet and" should read --the sheet and--; and
Line 49, "on to" should read --onto--.

Signed and Sealed this

Seventh Day of July, 1998

Bruce Lehman

*Attest:*

BRUCE LEHMAN

*Attesting Officer*

*Commissioner of Patents and Trademarks*